US012098636B2

(12) United States Patent
Palmer

(10) Patent No.: US 12,098,636 B2
(45) Date of Patent: Sep. 24, 2024

(54) UNDERGROUND MINING METHODS VIA BOREHOLES AND MULTILATERAL BLAST-HOLES

(71) Applicant: Daniel B. Palmer, Santa Barbara, CA (US)

(72) Inventor: Daniel B. Palmer, Santa Barbara, CA (US)

( * ) Notice: Subject to any disclaimer, the term of this patent is extended or adjusted under 35 U.S.C. 154(b) by 0 days.

(21) Appl. No.: 18/537,007

(22) Filed: Dec. 12, 2023

(65) Prior Publication Data

US 2024/0110478 A1 Apr. 4, 2024

Related U.S. Application Data

(63) Continuation of application No. PCT/US2022/053093, filed on Dec. 16, 2022.

(60) Provisional application No. 63/293,057, filed on Dec. 22, 2021.

(51) Int. Cl.
*E21C 41/16* (2006.01)
*E21F 15/08* (2006.01)

(52) U.S. Cl.
CPC ..... *E21C 41/16* (2013.01); *E21F 15/08* (2013.01)

(58) Field of Classification Search
CPC .... E21C 41/16; E21B 41/0035; E21B 43/263; E21F 15/08
See application file for complete search history.

(56) References Cited

U.S. PATENT DOCUMENTS

| | | | | |
|---|---|---|---|---|
| 3,917,346 | A | 11/1975 | Janssen | |
| 4,353,598 | A | 10/1982 | Ricketts | |
| 4,451,088 | A * | 5/1984 | Wisseroth | E21B 43/292 166/299 |
| 2007/0272110 | A1 | 11/2007 | Brent et al. | |
| 2013/0000908 | A1* | 1/2013 | Walters | E21B 43/263 166/299 |
| 2013/0199789 | A1* | 8/2013 | Liang | E21B 43/263 166/305.1 |
| 2013/0341029 | A1* | 12/2013 | Roberts | E21B 43/263 166/308.1 |
| 2014/0034304 | A1 | 2/2014 | Eisenschmid et al. | |
| 2017/0241266 | A1* | 8/2017 | Cherry | E21B 43/29 |
| 2019/0353018 | A1 | 11/2019 | Kemick | |

OTHER PUBLICATIONS

Search Report and Written Opinion, International Application No. PCT/US2022/053093 issued Mar. 29, 2023.

* cited by examiner

*Primary Examiner* — Carib A Oquendo
(74) *Attorney, Agent, or Firm* — Richard A. Fagin

(57) ABSTRACT

A method for underground mining in a rock body include drilling one or more service boreholes from at least one surface location into a subsurface rock body. A plurality of multilateral blast holes is drilled, branching from at least one of the one or more service boreholes into the subsurface rock body. The plurality of multilateral blast holes are each loaded with one or more explosive charges and one or more detonators. The one or more explosive charges and the one or more detonators are inserted from surface. The one or more explosive charges is detonated wirelessly to fragment the subsurface ore body. Fragmented rock is extracted via the one or more service boreholes, to surface.

30 Claims, 12 Drawing Sheets

UNDERGROUND MINING METHODS VIA BOREHOLES AND MULTILATERAL BLAST-HOLES

CROSS REFERENCE TO RELATED APPLICATIONS

Continuation of International Application No. PCT/US2022/053093 filed on Dec. 16, 2022. Priority is claimed from U.S. Provisional Application No. 63/293,057 filed on Dec. 22, 2021. Each of the foregoing applications is incorporated herein by reference in its entirety.

STATEMENT REGARDING FEDERALLY SPONSORED RESEARCH OR DEVELOPMENT

Not Applicable.

NAMES OF THE PARTIES TO A JOINT RESEARCH AGREEMENT

Not Applicable.

BACKGROUND

This disclosure relates to the field of underground mining of minerals. Known underground mining methods either require open pit excavation where overburden rock is removed prior to mining the target ore, or use underground mines that enable selective mining of the target ore. Underground mining require miners to work underground, necessitating expensive supporting structures, ventilation, cooling and de-watering.

As global demand for mined minerals increases, high concentration or high grade minerals near the earth's surface have largely been mined. Miners must either go deeper in search of high grade minerals, or mine and process massive volumes of low grade material at surface to obtain useable ore. This problem is particularly acute for copper, nickel, and cobalt which are critical to the manufacture of renewable energy infrastructure and electric vehicles.

Known mining methods use explosives placed in blast holes drilled in the zone of interest to blast rock into small fragments, which can then be extracted to surface and processed to remove the valuable ore minerals. It is widely accepted that blasting is the most energy efficient way of fragmenting rock.

As mines go deeper in search of valuable minerals, they experience higher operating temperatures, water ingress, and risk of rock busts and other geotechnical risks to personnel working underground. To mitigate these risk expensive ventilation, cooling de watering and steel and concrete support structures are installed at great cost.

There is a need for methods that enable ore bodies deep underground to be extracted to surface without either removal of overburden or requiring miners to work underground.

SUMMARY

One aspect of the present disclosure relates to a method for underground rock mining. A method according to this aspect includes drilling one or more service boreholes from at least one surface location into a subsurface rock body. A plurality of multilateral blast holes is drilled, branching from at least one of the one or more service boreholes into the subsurface rock body. The plurality of multilateral blast holes are each loaded with one or more explosive charges and one or more detonators. The one or more explosive charges and the one or more detonators are inserted from surface. The one or more explosive charges is detonated wirelessly to fragment the subsurface ore body. Fragmented rock is extracted via the one or more service boreholes, to surface.

In some embodiments, after a volume of fragmented rock has been extracted, a fluid is flushed through fragmented rock remaining underground to extract a soluble or finely fragmented constituent of the remaining rock.

In some embodiments, at least a portion of the one or more service boreholes is drilled to intersect in or near to a zone in the subsurface rock body to be extracted. A point of intersection of the at least a portion of the one or more service boreholes is used as a location reference for other drilling operations.

In some embodiments, at least one service borehole is drilled using magnetic ranging or electromagnetic ranging relative to another borehole.

In some embodiments, the one or more of the plurality of multilateral blast holes are steered relative to measured geophysical properties of the subsurface rock body using sensors disposed on a drilling assembly to optimize a position of the one or more of the plurality of multilateral blast holes.

In some embodiments, the plurality of multilateral blast holes are navigated within the subsurface rock body by measuring at least one property of drill cuttings collected at surface related to mineral composition.

In some embodiments, the one or more multilateral blast holes are drilled using a sensor that controls directional drilling so as to drill vertically to maintain survey accuracy.

Some embodiments further comprise injecting tailings from surface into a void space created after a volume of the fragmented rock is extracted.

In some embodiments, the fragmented rock is extracted via one or more service boreholes using a winch-conveyed device to recover the fragmented rock from an underground muck pile and to move the fragmented rock to surface.

In some embodiments, the winch-conveyed device is run inside a casing disposed within at least one of the two of the one or more service boreholes, wherein the winch-conveyed device latches into the casing and the casing is pushed into the muck pile to assist in filling the winch-conveyed device.

In some embodiments, the service boreholes are drilled to intersect a lowermost point of the muck pile, and wherein the winch conveyed device comprises a bottom having a one way mechanism allowing fragmented rock to be collected when it is run into the muck pile.

In some embodiments, the winch conveyed device collects material by means of downward hammering action or vibration using a mass and cable.

In some embodiments, the one or more service boreholes comprise a first extraction borehole inside which is deployed a container to extract the fragmented rock, the container deployed on a winch, and the one or more service boreholes comprises at least a second extraction borehole drilled to intersect first extraction borehole from a stope containing fragmented rock such that gravity feeds fragmented rock into the second extraction borehole, wherein a container disposed in the second extraction borehole hoists the fragmented rock to surface.

In some embodiments, movement of the fragmented rock is controlled via a drill pipe or rod inserted into the second extraction borehole operated from surface, whereby the drill pipe or rod acting within the second borehole reduces fragment size of the fragmented ore.

In some embodiments, mechanical action by a drill pipe or cable conveyed device, or insertion of explosive devices in at least one of the or more service boreholes drilled through the subsurface rock body break the fragmented rock into smaller fragments to allow extraction of the smaller fragments to surface at least one of the one or more service boreholes.

In some embodiments, the fragmented rock is extracted the use of a jet pump conveyed by concentric or parallel jointed pipes in at least one of the one or more service boreholes.

In some embodiments, the plurality of multilateral blast holes are drilled using a whipstock device located within a pipe configured to be moved along a service borehole, and rotated within the service borehole and; an opening in said pipe facilitating subsequent directional drilling a blast-hole multilateral branch from the service borehole.

In some embodiments, the pipe is moved to a starting location and orientation for drilling each of a plurality of blast-hole multilateral branches, and then after each of the plurality of multilateral blast holes are drilled from each of the blast-hole multilateral branches, the pipe is returned to each starting location and orientation to facilitate loading of explosives into each of the plurality of multilateral blast-holes.

In some embodiments, the plurality of multilateral blast holes are drilled using an apparatus comprising; a pipe inserted into at least one of the one or more service boreholes. The pipe is anchored in place. The pipe comprises a plurality of pre-cut windows to facilitate drilling a multilateral blast-hole, a plurality of locating devices to allow installation and locking of a whipstock with a corresponding one of the plurality of locating device in a desired location to drill a set of multilateral blast-holes and a mechanism to release said whipstock to allow a next one in a sequence of sets of multilateral blast-holes to be drilled.

In some embodiments, the one or more explosive charges is loaded into at least one of the plurality of multilateral blast holes using an outer pipe having diameter smaller than a multilateral blast hole branch and a flexible inner sleeve having a diameter expandable to fill the multilateral blast hole branch. The flexible inner sleeve is inserted inside the outer pipe. The inner sleeve is filled with explosives, boosters and detonators. The outer pipe and the flexible inner sleeve are run into the multilateral blast hole branch on a pipe. A release mechanism is triggered to place the explosives in a desired position, and the flexible inner sleeve is released inside the multilateral blast hole branch. The outer pipe is removed leaving the explosives expanding in the flexible inner sleeve to fill effectively an entire diameter of the multilateral blast hole branch.

In some embodiments, the one or more detonators is initiated with radio frequency signals having a specific identifier and firing code.

In some embodiments, the fragmented rock is extracted using a pair of extraction boreholes drilled from surface to intersect proximate the subsurface rock body, wherein a cable is looped downward in one of the pair of extraction boreholes and upward in the other of the pair of extraction boreholes. Extraction equipment attached to the cable is used to lift the fragmented rock to surface by movement of the cable.

A method of underground mining in rock according to another aspect of the present disclosure includes drilling one or more service boreholes from a surface location into an underground rock body. A plurality of multilateral blast holes is drilled branching from one of the one or more service boreholes. One or more of the multilateral blast holes is loaded with one or more explosive charges and one or more detonators. The one or more explosive charges and the one or more detonators are inserted from surface. The one or more explosive charges is wirelessly detonated to fragment the underground rock body. Fragmented rock is extracted via an existing mine.

In some embodiments, the plurality of multilateral blast holes are steered relative to measured geophysical properties of the underground rock body using sensors disposed on a drilling assembly to optimize a position of the one or more multilateral blast holes.

In some embodiments, the plurality of multilateral blast holes are navigated within the rock body by measuring at least one property of drill cuttings collected at surface, the at least one property related to mineral composition.

In some embodiments, the plurality of multilateral blast holes are drilled using a whipstock located within a pipe configured to be moved along a service borehole and rotated within the service borehole, an opening in said pipe facilitating directional drilling a subsequent blast-hole multilateral branch from the service borehole.

In some embodiments, the pipe is moved to a starting location and orientation for drilling each one of a plurality of blast-hole multilateral branches. The method further comprises drilling a set of multilateral blast holes from each of the plurality of blast hole multilateral branches, wherein after the set of multilateral blast holes is drilled from each blast-hole multilateral branch, the pipe is then returned to the starting location and orientation to facilitate loading of explosives into each of the set of multilateral blast holes drilled from each blast-hole multilateral branch.

In some embodiments, the plurality of multilateral blast holes are drilled using an apparatus comprising; a pipe inserted into one of the one or more service boreholes, the pipe anchored in place in the one of the one or more service boreholes. The pipe comprises a plurality of pre-cut windows to facilitate drilling a multilateral blast-hole, and a plurality of locating devices to allow installation and locking of a whipstock with a corresponding locating device in a desired location to drill a set of multilateral blast-holes. The pipe also comprises a mechanism to release said whipstock to allow a next one in the set of blast-holes to be drilled.

In some embodiments, the one or more explosive charges are loaded into at least one of the plurality of multilateral blast holes using an outer pipe having a diameter smaller than a multilateral blast hole branch and a flexible inner sleeve having a diameter expandable to fill the multilateral blast hole branch. The flexible inner sleeve is inserted inside the outer pipe, and is filled with explosives, boosters and detonators. The outer pipe and the flexible inner sleeve are run into the multilateral blast hole branch on a service pipe. The method further comprises releasing a mechanism triggered to place the explosives in a desired position, wherein the flexible inner sleeve is released inside the multilateral blast hole branch and expanded; and the outer sleeve is removed leaving the explosives expanded in the released flexible inner sleeve to fill the diameter of the multilateral blast hole branch.

In some embodiments, at least one of the one or more detonators is initiated with radio frequency signals having a specific identifier and firing code.

A method of underground mining in rock according to a further aspect of the present disclosure includes drilling one or more service boreholes from a surface location into an underground rock body. A plurality of subterranean multilateral blast holes is drilled into the rock body. The plurality of subterranean multilateral blast holes branch from at least one of the one or more service boreholes. The subterranean multilateral blast holes are loaded with one or more explosive charges and one or more detonators, which are inserted from surface. The one or more explosive charges is detonated wirelessly to fragment the underground rock body. A fluid is flushed through the fragmented underground rock body to extract a soluble or finely fragmented constituent of the fragmented underground rock body.

In some embodiments, a least a portion of the one or more service boreholes are drilled to intersect in or near to the underground rock body, a point of intersection used as a location reference for other drilling operations.

In some embodiments, two of the one or more service boreholes are drilled using magnetic or electromagnetic ranging.

In some embodiments, the plurality of subterranean multilateral blast holes are steered relative to measured geophysical properties of the underground rock body using sensors on a drilling assembly to optimize a position of the plurality of multilateral blast holes.

In some embodiments, the plurality of subterranean multilateral blast holes are navigated within the underground rock body by measuring at least one property of drill cuttings collected at surface, the at least one property related to mineral composition.

In some embodiments, parts of the plurality of subterranean multilateral blast holes are drilled using a sensor that controls directional drilling to drill vertically to maintain survey accuracy.

Some embodiments further comprise injecting tailings from surface into the subsurface via at least one of the one or more service boreholes after a volume of the fragmented underground rock body is extracted.

In some embodiments, the fragmented underground rock body is extracted using a jet pump conveyed by nested or parallel jointed pipes disposed in at least one of the one or more service boreholes.

In some embodiments, the plurality of subterranean multilateral blast holes are drilled using a whipstock located within a pipe configured to be moved along a service borehole and rotated within the service borehole, wherein an opening in said pipe facilitates directional drilling a blast-hole multilateral branch from the service borehole.

In some embodiments, the pipe is moved to a starting location and orientation within the service borehole for drilling of each of a plurality of blast-hole multilateral branches. After each of the plurality of multilateral blast holes is drilled, the pipe is returned to each starting location and orientation to facilitate loading of explosives into each of the plurality of multilateral blast holes drilled from each blast-hole multilateral branch.

In some embodiments, the plurality of multilateral blast holes are drilled using an apparatus comprising; a pipe inserted into at least one of the one or more service boreholes and anchored in place in the at least one service borehole, wherein the pipe comprises a plurality of pre-cut windows to facilitate drilling one or more of the plurality of subterranean multilateral blast-holes. The pipe further comprises a plurality of locating devices to allow installation and locking of a whipstock with a corresponding locating device in a desired location in the at least one service borehole to drill a set of the plurality of subterranean multilateral blast-holes. The pipe further comprises a mechanism to release said whipstock to allow a next one in a sequence of multilateral blast-holes to be drilled.

In some embodiments, the one or more explosive charges is loaded into at least one of plurality of subterranean multilateral blast holes using an outer pipe having diameter smaller than a diameter of a multilateral blast hole branch and a flexible inner sleeve having diameter expandable to fill the multilateral blast hole branch. The flexible inner sleeve is inserted inside the outer pipe. The flexible inner sleeve is filled with explosives, boosters and detonators. The outer pipe and the inner sleeve are run into the multilateral blast hole branch on a conveyance pipe. A release mechanism is triggered to place the explosives in a desired position, the flexible inner sleeve is released and expanded inside the multilateral blast hole branch, and the outer sleeve is removed leaving the explosives expanding in the flexible inner sleeve to fill the diameter of the multilateral blast hole branch.

In some embodiments, the one or more detonators is initiated with radio frequency signals having a specific identifier and firing code.

Other aspects and possible advantages will be apparent from the description and claims that follow.

BRIEF DESCRIPTION OF THE DRAWINGS

FIG. 7B also shows detail of extraction machinery using wire loop method via two boreholes.

DETAILED DESCRIPTION

Figure 1:
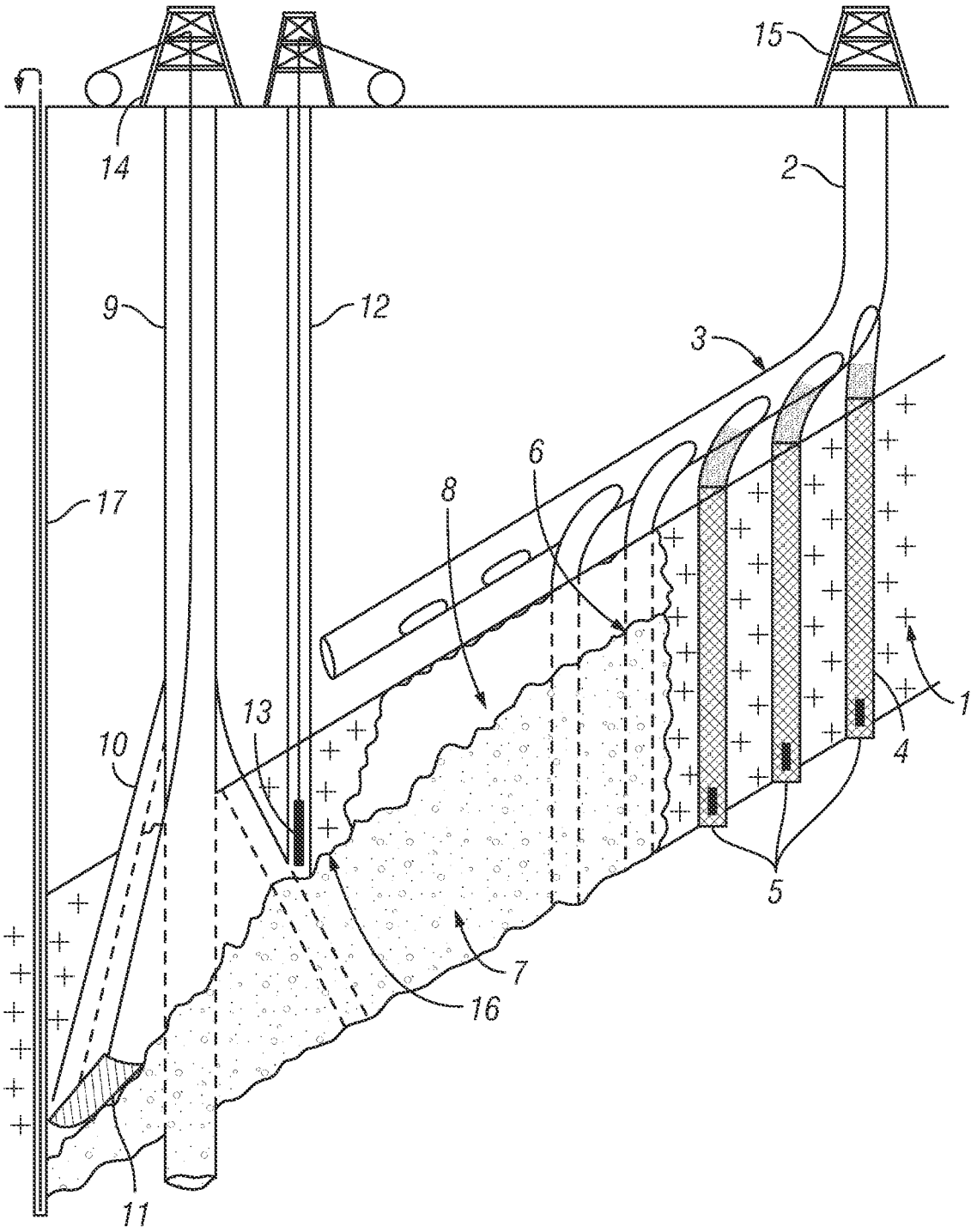
FIG. 1 shows a side view of the overall method of underground mining via boreholes and multilateral blast holes.

Methods and apparatus described herein enable locating bore holes in or near a rock body deep underground to be extracted to surface without removal of overburden or requiring miners to work underground. The disclosed methods use new machines, techniques and geometries of mining to enable such extraction.

Methods according to the present disclosure may be considered akin to keyhole surgery for orthopedics, where a small hole is used to precisely remove a problematic element from a joint.

In the case of mining, methods according to the present disclosure provide a step change in economic outcomes, energy use, safety of personnel, material requirements and environmental impact. The disclosed methods can access ore reserves previously impossible to mine safely and economically today.

By creating multiple separate void spaces sequentially by blasting, and reducing the waste rock removed for tunnels, it is possible to re-inject a slurry of tailings into the void spaces reducing or eliminating the need of hazardous and environmentally risky tailings dams.

The disclosed methods have the following key elements:

(A) a method to create an initial void space to allow drilling and blasting to commence (B) Various systems to replace a drilling rig underground with a multilateral drilling system operated from surface (C) Various systems to load explosives into the multilateral blast holes and detonate them remotely (D) Various systems to replace underground rock removal systems with a system operated from surface which extracts material via a borehole or plurality of boreholes (E) Various systems to locate the drilling and blasting precisely relative to the ore body and conduct grade control functions; and (F) Specific methods for leaching low grade ore following on from extracting rock (G) Methods related to operating to existing mine workings.

In methods according to this disclosure, the entire mining operation is performed using equipment operated from surface, or a prior mined location similar to operations performed using a drilling rig for oil and gas drilling via one or more boreholes. Blasting is known as the most cost and energy efficient method of fragmenting rocks in the mining industry today, and is the primary method of creating fragmented rock that can be extracted in this method.

A typical sequence of mining operations is described herein. The actual geometry, engineering choices and extraction methods selected will depend on factors such as geology of the mineral resource, depth, rock properties of the ore and overburden, prior mine workings and other factors. As such the disclosure describes non limiting examples as illustrations of the method. At least a first "service" bore hole extends to a rock or ore body below ground. Such first borehole may extend to great depth, e.g., several hundreds or thousands of meters, in order to penetrate the rock or ore body. This at least one borehole enlarged in the target zone, i.e., the ore body, to be as large as practical to allow void space for the blasting process to initiate. Enlargement may be performed, for example, using reaming devices, or by drilling multilateral blast holes from the first or another borehole.

As used in the present disclosure, the term "service" is intended to mean any activity that can be carried out or performed in a borehole, including, without limitation, movement of tools and equipment, movement of fluids and movement of solids, such as rock fragments. The term "service" is not intended to limit the scope of activities performed in any borehole but is used only to clearly identify the relevant borehole(s) when needed for purposes of clarity of the disclosure.

In some embodiments, a second service borehole (for use as starting point for blast holes) may be drilled, with a bottom hole location nearby the first borehole, then a number of multilateral branches are drilled from the second service borehole. There may be several of such blast holes in a large mining operation. When drilling the blast holes is complete, explosives are inserted into each multilateral branch blast hole. The explosives are detonated remotely, e.g., using radio signals that penetrate underground or by using hydraulic pressure signals. To efficiently blast and remove the rock, explosives closest to the first borehole or any similar borehole used for extraction, are detonated first. Then the fragmented material known as a "muck pile", is extracted through a service borehole. The foregoing process is repeated and a void space or "stope" is created. The size and shape of the stope will be designed with rock stability in mind and it may use features such as supporting pillars left in place or arched roof geometries to prevent collapse of stope. It is known that rock fragmentation by blasting is the most energy efficient way to fragment rock and many of the innovations are to allow for a high degree of fragmentation by blasting using this method to optimize efficiency.

Although the present example embodiment contemplates creating at least a second service borehole as a primary or "pilot" hole for subsequent multilateral drilling activities, it should be clearly understood that multilateral blast holes as described herein may be drilled from the first service borehole, wherein the first service borehole is used afterward for extraction activities to be described further below.

The fragmented rock may be extracted via an extraction device disposed in the first borehole. There are many different methods of extraction that may be used in accordance with the present disclosure, depending on depth, rock properties, water level and volumes to be extracted. The extraction device may use either pumped fluids, usually water under pressure, to lift small fragments of rock in a slurry to surface, or a mechanical bucket filled via a separate shaft or dropped or forced into the muck pile using the bucket weight, momentum or pushed inside a pipe string, or dragged with cables.

At surface any water in the extracted mineral may be separated.

The first fundamental innovation according to the present disclosure is a series of processes and machines that enable the functions of drilling and blasting to be performed in underground mining from surface via one or more borehole(s) using directional drilling technology and multilateral blast holes, which can be drilled, steered, and loaded with explosives and detonated in sequence from surface. The present example method may enable a range of mine development geometries that are novel and differ significantly from geometry of mines developed today. The methods described herein require precise surveying of the position of blast holes to create geometry and spacing to allow effective blasting.

Other fundamental innovations include methods to bring to surface efficiently and economically the resulting material that has been blasted into fragments using winch conveyed scoops or "bailers", or hydraulic forces in a string of pipes or hydraulic lift of a power fluid such as water or air. Such material may be extracted through one or more service boreholes. The bailers or buckets may be run inside a casing pipe and forced into the muck pile by the pipe. In other methods buckets conveyed on cables are used to extract ore.

The present example method will in general target high grade ore at depths more than 100 m below surface. Ore bodies at shallower depths would likely be less economic than open pit mining. In any situation the present example method may be advantageous as it reduces surface environmental impact and risk and may allow mines to be permitted in areas normally off limits for existing mining methods.

Ore is used to refer to the material to be extracted; this can be a mineral mined and may include veins containing pure metals such as gold and silver, and ores of copper, lead, zinc, cobalt, nickel, or other metals. Generally, the method is expected to be most advantageous for valuable higher grade deposits deposited deeper in the subsurface, however it can apply to any material to be mined underground.

The present example method is a completely new method of mining that has not been previously conceived as it requires several recent developments in both mine blasting equipment and oilfield drilling equipment and their cost effectiveness as a starting point. From mining technology, the use of a remotely operated detonator that is fired using radio frequency signals transmitted through the rock is required. From the oil and gas drilling industry, it requires directional drilling, multilateral drilling, hard rock drill bits and may also require geo-steering, short radius drilling, closed loop directional drilling controls, rotary steerable drilling assemblies and gyroscopic surveys while drilling to maximize efficiency and survey accuracy.

Built on top of this, the fundamental innovations are in the following areas:

The concept of mining from surface via multilateral blast holes;

A novel sequence of drill and blast operations to make such multilateral drill and blast operations possible.

A novel geometry of drill and blast operations to make such multilateral drill and blast operations possible.

Apparatus to efficiently drill and then re-enter multilateral blast holes.

Methods to ensure the blast holes are drilled in the optimum position ensure the ore to waste dilution is minimized.

Geophysical measurements, wireline logging, logging while drilling and other sensors will be used within the borehole to assess ore properties, rock mass properties, depth of borehole intersection and proximity throughout the process. It is expected to apply many technologies from oil and gas extraction to the processes to provide information regarding rock physical properties.

Apparatus to efficiently load said multilateral blast holes safely with explosives, and to ensure said explosives completely fill the cross section of said blast hole for maximum effect.

Methods and apparatus to extract the resulting fragmented material or "muck pile" from the subsurface via hydraulic jet pumps or other pumping of slurry in suspension.

Methods and apparatus to construct a plurality of shafts and recovery method to extract the fragmented material via buckets lowered and retrieved via cables and with winding gear from draw points in the underground muck pile. These buckets may run inside and latch into a casing pipe to force them into the muck pile.

As the disclosed method does not require the complete dewatering of the area to be mined or removal of risk of rock falls or rock burst, it may allow mining from much deeper deposits than previously possible. It may allow mining in areas with high temperatures, poisonous gas presence or geotechnical instability too hazardous for conventional underground mining methods to be undertaken. The method does not require block caving and can extract and replace ore bodies without major surface subsidence in some cases.

It is likely the disclosed method may be most advantageous in mining ore deposits in steeply dipping veins or stopes that are relatively narrow.

In general, "drilling" and "drill" refers to rotary drilling as is commonly employed in drilling oil gas and water wells into subterranean formations. This method assumes the use of commonly used directional drilling equipment and methods for its execution. In general, when employing these methods in this application, several differences will allow for lower cost of execution.

For all of the subsurface equipment shown, it is within the scope of this disclosure that a drilling rig system similar to those used for drilling an oil, gas or water wells is at surface to provide: the means of running jointed pipe in and out of the boreholes, the means of providing mechanical forces on said pipe vertical and torsionally, the means of high pressure pumping of water or drilling fluid, the means of taking returns of drilling fluid, water and rock cuttings and removing them from the fluid.

Firstly, low cost water based mud may be used instead of expensive drilling fluids as there is no need for weighted fluids or control of fluid losses. In the case that the mine is above the water table, (free water level) then air, foam or other low density fluids may be used for drilling to prevent excessive losses. Secondly no pressure control equipment such as blow out preventers will be required as the rocks to be drilled will not contain hydrocarbons or over pressured zones.

Although deep for mining operations, these operations will be relatively shallow compared with oilfield drilling as such equipment for lower pressures, and lower temperatures may significantly lower in cost.

There may be one respect in which the drilling may in some cases be more costly and that is the fact that minerals often occur in hard rock that is metamorphic or igneous. Hard rock drill bits and methods may be required such as roller cone bits or hydraulic hammer devices.

In general, 'surface' refers to the earth's surface, however this method may be used to deepen a mine from an existing excavation, where people are engaged in the mining process, and this should be considered throughout the description. In this case surface can be considered to be a position where there are manned operations in an existing mine.

The method creates a plurality of stopes and reduces the waste rock normally generated for connecting tunnels and roadways. Also, separate stopes that are hydraulically isolated and dewatered can then be used to dispose of tailings eliminating the need for surface tailings dams.

In some cases where the minerals are soluble after blasting, the muck pile may remain in situ and be extracted via leaching or solution mining processes.

The method may be used to exploit the remaining ore in areas that have been previously mined using conventional methods, but cannot be exploited further due to water ingress, instability of the rock or other hazards or economic impediments. In this case the multilateral drilling and blasting may be used to create rock muck piles that are then extracted via the methods described herein or using existing mine workings, using traditional methods, or via in-situ leaching.

The methods herein envisage initially using downhole equipment from oil and gas drilling with some modifications and relatively simple mechanical devices. Once the method is established innovation in robotics will lead to further development of robotic devices to improve the performance of various key function of the process. Some examples of this are listed. (i) Robotic mechanisms for the movement and alignment of the whipstock for drilling multilateral blastholes without removing the drill pipe from the hole. (ii) Loading explosives safely into the blast-holes after drilling with the minimum number of drill-pipe trips, including the movement and alignment of the whipstock for inserting explosives without removing drill-pipe from the borehole. (iii) Improving the efficiency of extraction of rock with a robotic loading device to handle loading rock and ore fragments into an extraction device efficiently. (iv) Automating surface activities such as drilling, explosive loading, and unload the rock an ore from extraction devices.

The disclosed method is described herein as a sequence of steps to achieve the goal of extracting ore from an underground ore body in a safe, environmentally conscious and economically attractive way. These descriptions refer to some, but not all, of the possible realizations described in the drawing; in some cases, a step may have different options that are described in the drawings.

FIG. 1 shows a side view of the overall method of multilateral blast hole underground blast hole. The figure shows one simplified realization of the method as a general case. The ore body is a tilted stratum (1) marked with "+" shading.

The ore to be extracted may be accessed via a large diameter extraction borehole(s) (9) drilled to depth and in this case vertically drilled. This hole, in this case is enlarged in the ore body to create a "draw point" by drilling short multilateral blast holes and blasting an inverted cone shaped void space (10). The material is then extracted via drilling and circulation, or another extraction method described herein. This provides the initial space to allow larger blasting patterns to start and create fragments. It also serves to allow a bucket device (11) that is relatively long pass with be used like a drag line bucket or plunged into the muck pile at the draw point (10).

In FIG. 1, reference numeral (2) is a borehole drilled from surface from a drilling rig at surface (15) to drill multilateral blast holes to blast the stope. Once drilled alongside the stope down trend in this case, a multilateral casing assembly is put in place (3). Multilateral sidetracks are then drilled from these exit points into the ore body (4); these are filled with explosive with a radio frequency controlled detonator is placed inside the explosives, normally at the base (5). These are detonated in sequence to blast the rock into the smallest possible fragments. Generally, very high explosive loads or "powder factors" would be used give the smallest fragmentation of rock. (6) shows the location of prior holes that have been blasted, and (7) is the fragmented rock or "muck pile" remaining. (8) is the void space or stope which may be partially full of water. The geometry is designed such that a section of the roof of the stope 16 partially blocks the flow of muck pile down the stope such that there is a draw point. This is a free surface of the muck pile that allows the bucket device to operate on the muck pile without confining stress from the fragmented rock above.

Figure 5:
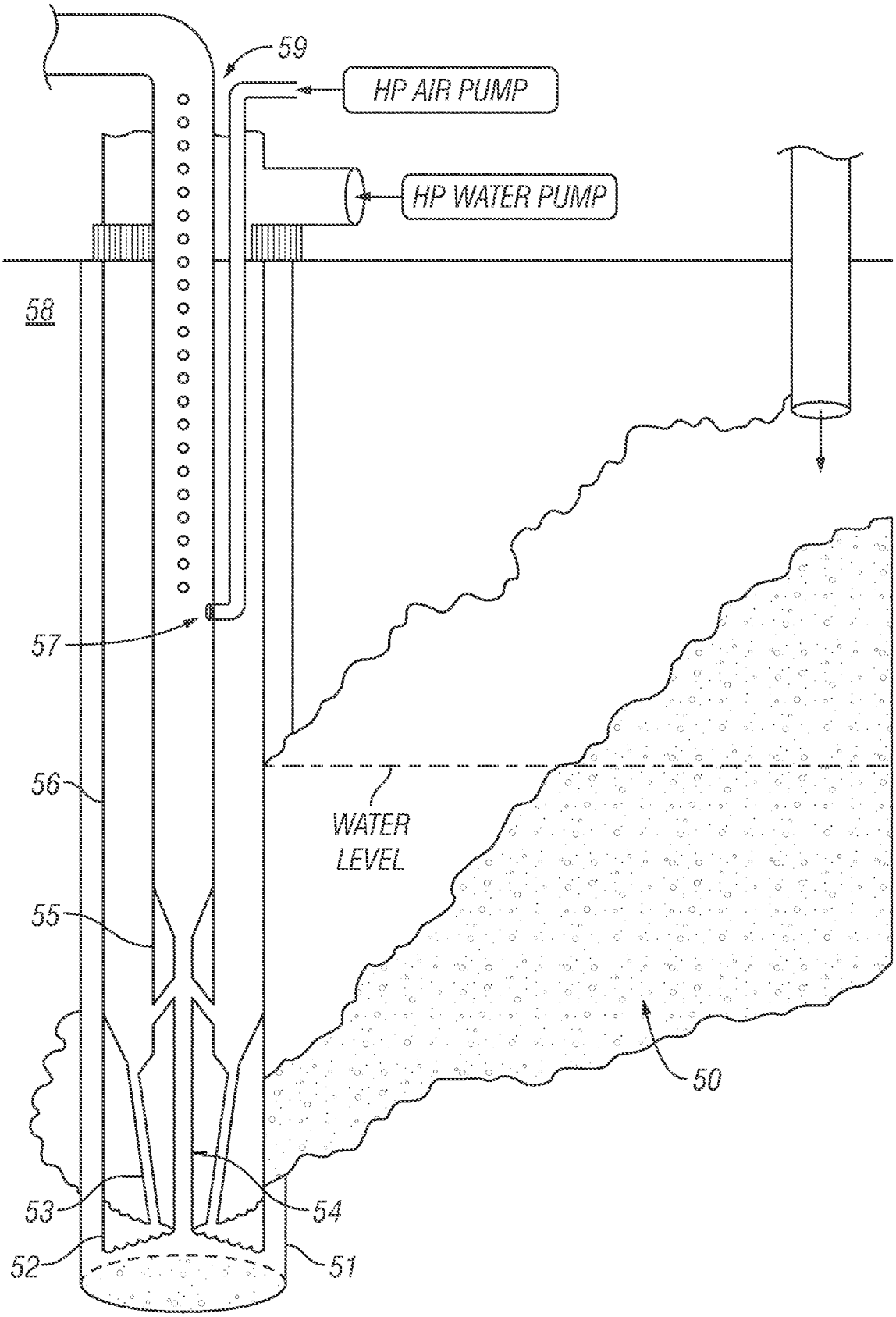
FIG. 5 shows a side view of extraction machinery using hydraulic jet pump.

The bucket device (11) is a cylindrical device with several components, which is repeatedly cycled up and down to extract ore and designed and operated to maximize the rock that can be taken per descent. The bucket device is conveyed on a wire rope at high speed from a winch at surface (14). In this case the bucket is dropped to the base of the draw point and gathers rocks by being dragged up the muck pile. In other cases, e.g., as shown in FIG. 5, it may be plunged into, or pushed into the muck pile to scoop up the material in a cylindrical bucked.

It is within the scope of this disclosure that there could be pairs of these holes so the bucket could run in opposition on a single shaft so that energy of the falling bucket can be recovered. It is within the scope of this disclosure that multiple shafts could be operated simultaneously to accelerate extraction.

Still referring to FIG. 1, an auxiliary borehole (12) is shown that would be drilled to intercept a draw point. This would allow, e.g., a high speed hammer (13) on a wire rope run from a winch (14) down and break oversized material. In some cases, explosives could be run down to clear an obstruction. Also, a drill rig could be used to drill out blockages in any of the shafts. An auxiliary borehole (17) may be drilled to extract water from the stope using the appropriate water pump system.

In some cases, borehole (3) may intersect (9), (12) or (17) to provide a position reference. This may be achieved using magnetic ranging techniques.

Figure 2:
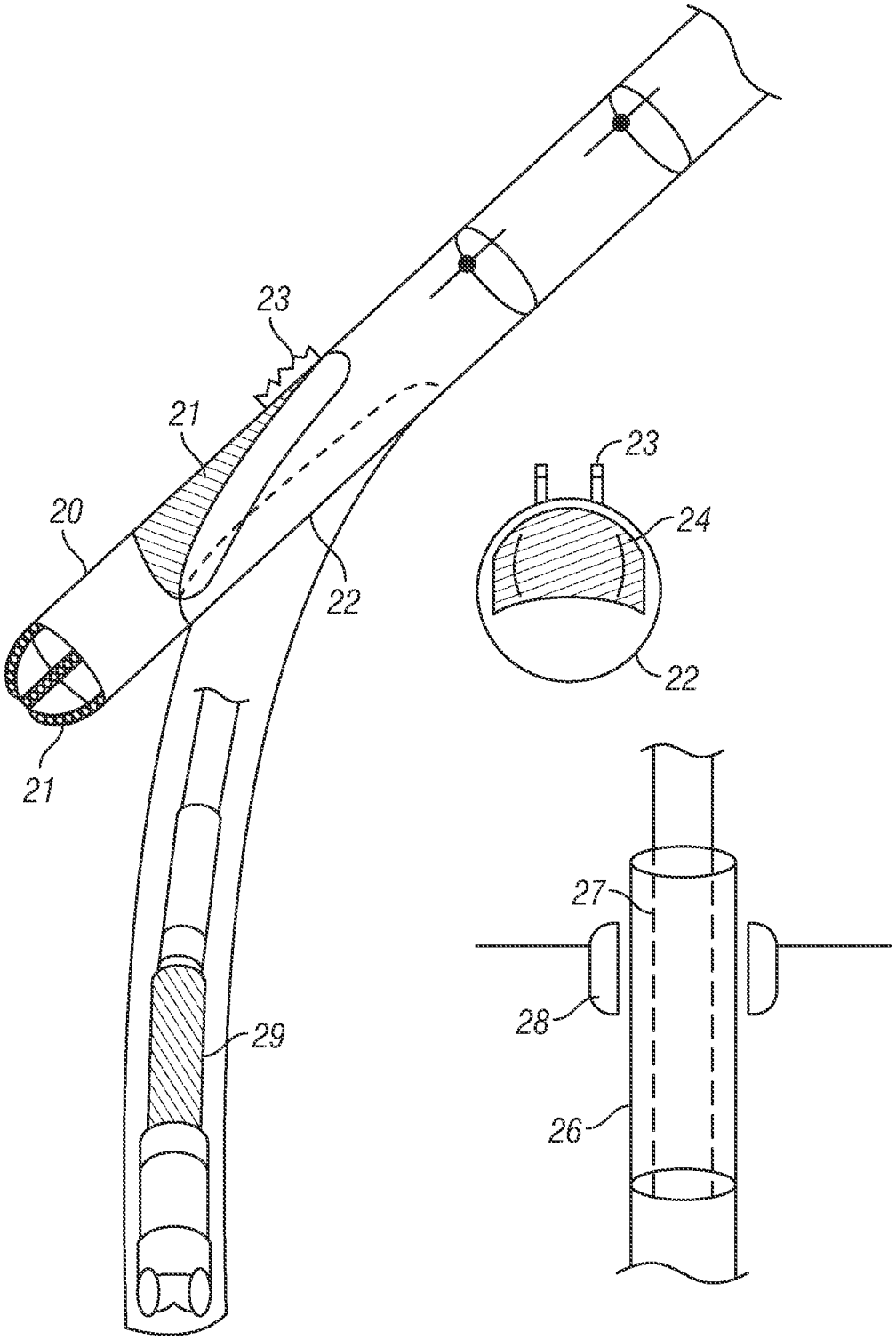
FIG. 2 shows several views of the movable casing multi-use multilateral whipstock device and drilling apparatus.

FIG. 2 shows several views of the movable casing multi-use multilateral whipstock device and drilling apparatus. Reference numeral (20) is a steel tubular (similar to casing used in oil well drilling) that is inserted into the multilateral borehole to drill a multilateral branch that houses the other components and is used to precisely locate the window (22) and whipstock (21) to guide subsequent drilling of multilateral branches in the desired orientation. (20) may also have a drill bit or mill to allow it to remove debris that may fall into the borehole. In some realizations the casing may not go to surface and be attached to a retrievable liner hanger, which is a mechanical device to hold casing in place in the hole.

Reference numeral (21) is the whipstock which is a solid body shaped to push the drill bit from subsequent drilling runs to drill out of the window and into the rock at a build angle determined by the shape of the whipstock ad and azimuth and depth determined by the position of the whipstock.

Reference numeral (23) is an anchor that may be required to push the assembly such that the gap between the window and borehole is reduced to prevent debris falling into the blast-hole.

At surface or some other control point, precise reference points (27) on the casing (26) are used to orient and position depth wise the assembly, and then firmly clamp (28) the system to remain stationary during the process of drilling the lateral.

The multilateral is drilled using directional drilling equipment (29) known in the art such as a bend sub, motor and MWD system.

The starting point for this system may in fact be a multilateral bore hole with one or more branches then being the basis for a plurality of multilateral blast-holes.

In general, from a single borehole shown in three dimensions to be drilled from a single borehole. There are few limitations to how many blast holes can be drilled from a single borehole, issues such as casing wear may be limiting factors. In cases where the operations are at great depths in hard rock using a single borehole for a large number of multilateral blast holes will be an economical advantage.

Generally, all the multilateral blast holes in a pattern are drilled in a sequence and each is left open. Explosives are inserted after the pattern is drilled to avoid any safety or regulatory issues related to drilling near to explosives.

Figure 2A:
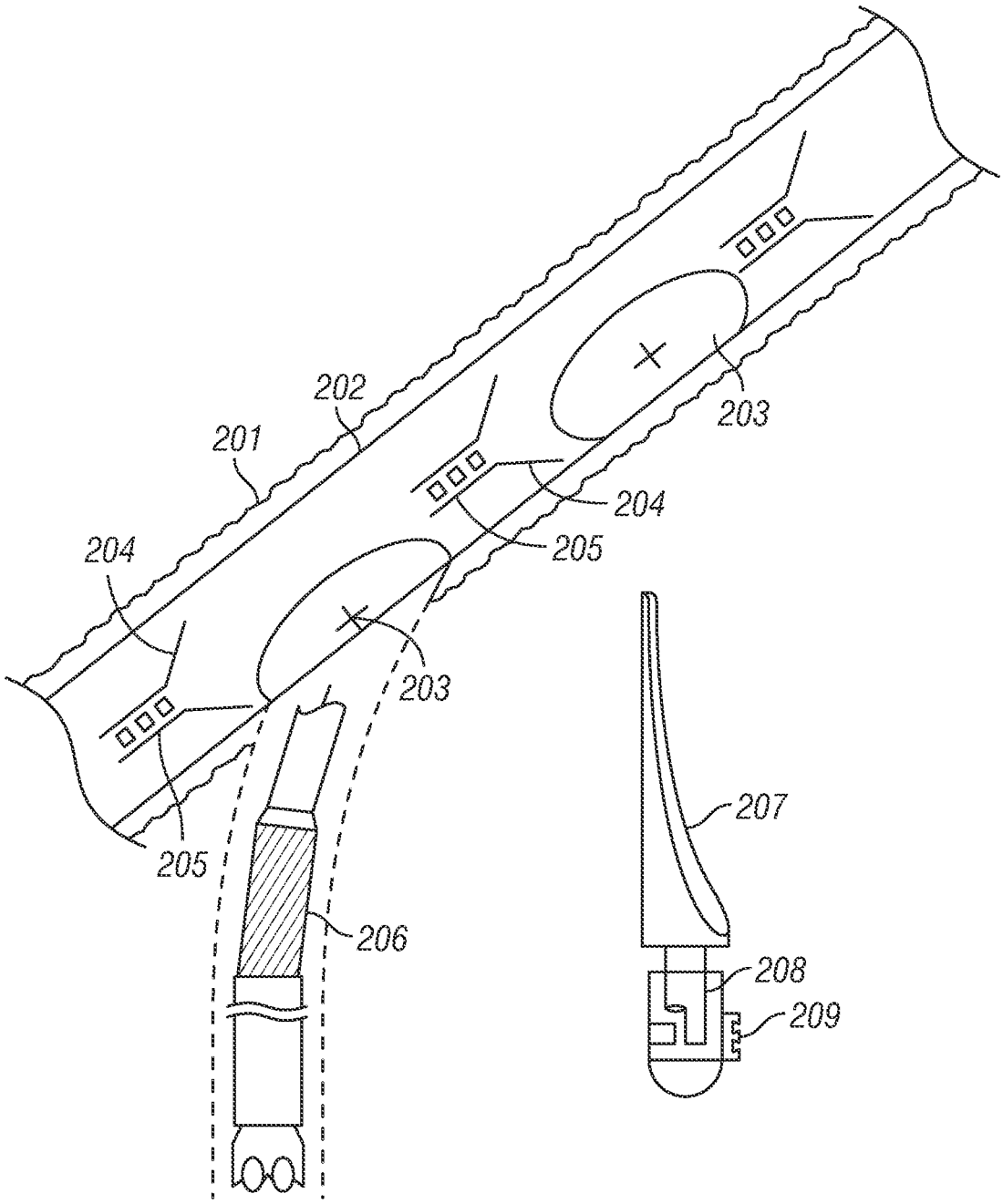
FIG. 2A shows a Movable whipstock inside pre-cut fixed casing with multiple multilateral windows exits.

FIG. 2A shows a movable whipstock inside pre-cut, fixed casing with multiple multilateral windows as exits. In another embodiment, a steel casing is set in the bore and said casing has a number of locating devices and exit holes to facilitate setting mechanical whipstocks and drilling multiple side tracks at different depths and positions along said casing. The pipe may have, e.g., internal mechanical profiles, or radio frequency identification (RFID) tags to accurately locate and orientate the exit drilling location and direction. The mechanical profiles would have the following features; an orientation profile to orient the whipstock in the correct azimuth, a unique profile so a mechanical key in the whipstock will only set in a single position, and a locking profile strong enough to allow drilling stresses. There would also be a release mechanism within the whipstock to remove it. In some realizations composite pipe may be deployed and may be cemented in place to prevent borehole collapse but allow rapid drilling of sidetracks.

Reference numeral (201) represents a parent main borehole drilled from surface.

Reference numeral (202) represents casing tubular inserted from surface, normally made of steel, sufficiently long to accommodate all multilateral exit points. In this case the casing is not moved. Casing may be run from surface to bottom or set in position with a "liner hanger" commonly used in oil and gas drilling.

Reference numeral (203) represents a plurality of exit windows pre-cut prior to installation in hole. These may be oriented in an array of orientations relative to the borehole.

Reference numeral (204) shows an orientation guide being a feature inside the casing, normally an internal profile to orient the whipstock assembly via a key (209)

Reference numeral (205) represents a lock profile that will form a "no-go" with Key (209) for a specific lateral to be drilled. This profile will allow all keys except for corresponding key to pass and the corresponding key will prevent any downward movement including with very high drilling force.

Reference numeral (206) represents a drilling assembly including directional drilling tools and drill bit that will pass through the window (203) as deflected by the whipstock (207).

The assembly of whipstock deflector (207), whipstock (208) and the key (209) would be run inside the casing (202) and set in the lock profile (205) at the appropriate position to allow drilling through the appropriate window (203).

Numeral (207) represents a whipstock deflector, steel deflector commonly used in oil and gas drilling. Whipstock may be run on an apparatus that can be released once in position.

Numeral (208) represents a whipstock orientation device allowing whipstock to orient and match the target window. Orientation is set prior to running.

Numeral (209) represents a key profile that locks in lock mechanism (205) and prevents rotation and downward motion when set. The key profile (209) Can be removed by pulling at a preset force to remove after drilling.

The foregoing system show in FIG. 2A would be appropriate where the rock mechanics or borehole quality precluded moving the casing due to debris or hole collapse during drilling and blasting.

Figure 3A:
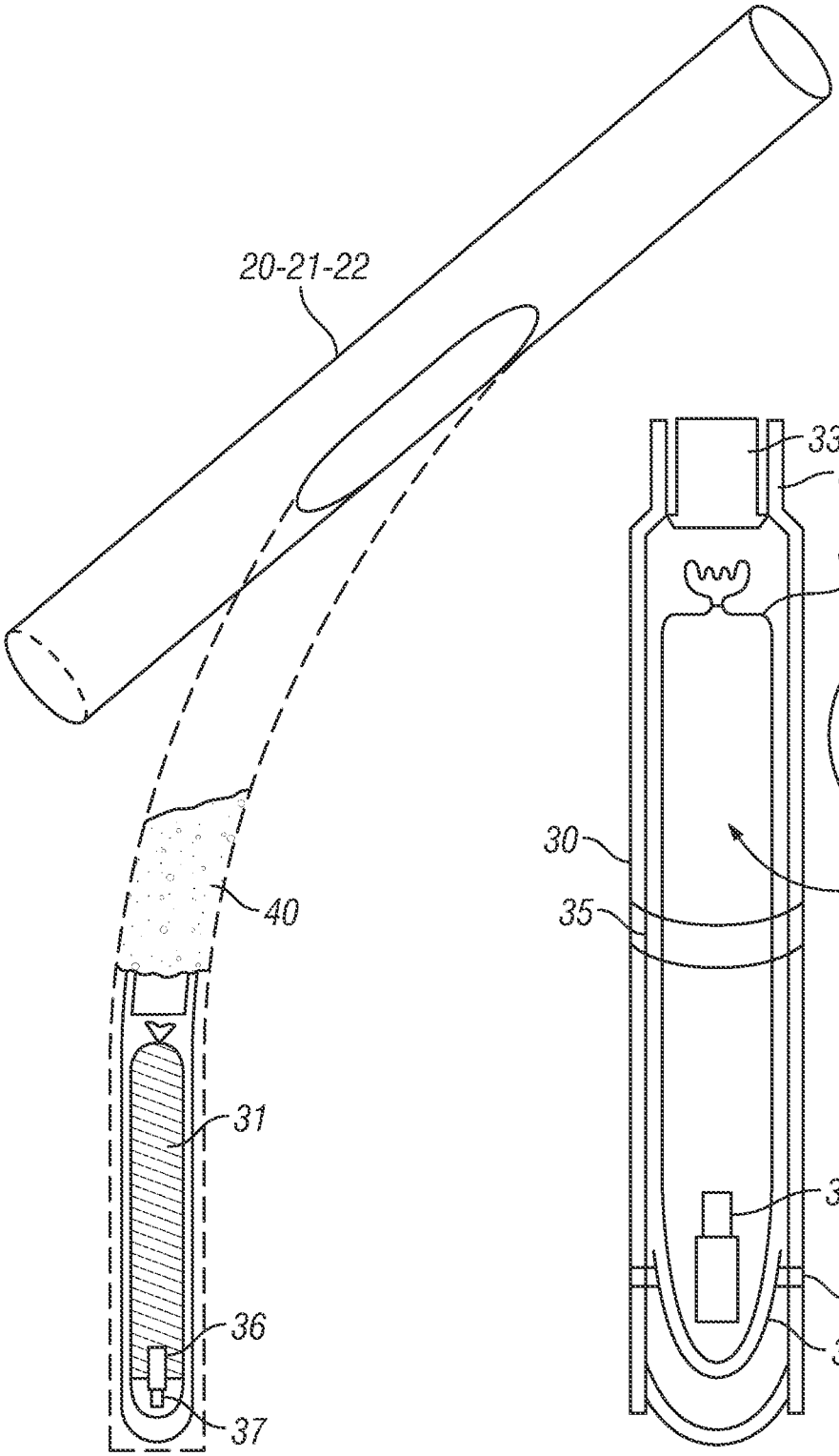
FIGS. 3A and 3B show views of a loading tube for explosives.
Figure 3B:
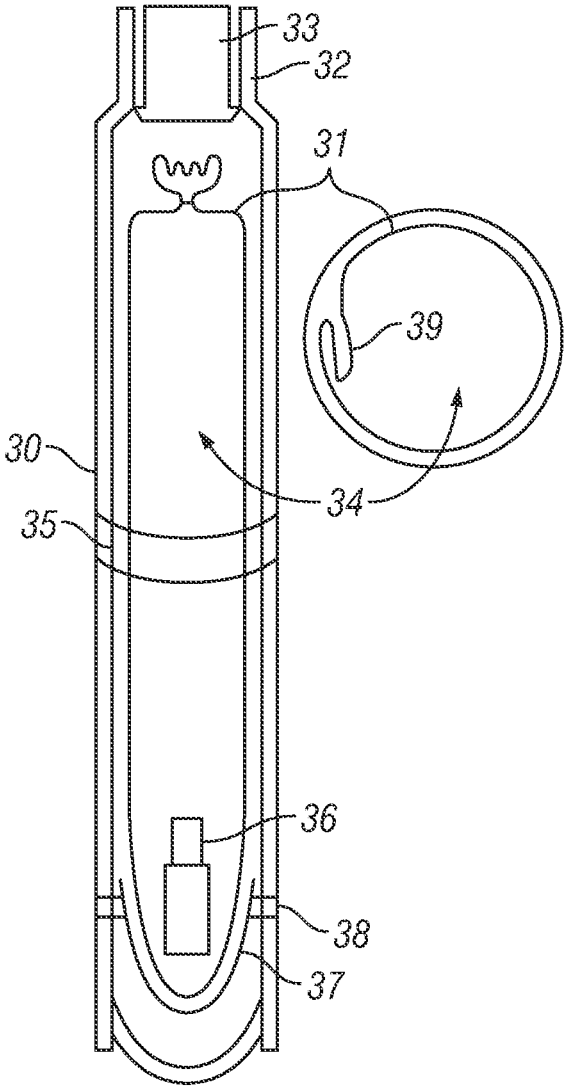

FIGS. 3A and 3B shows a side view of the multilateral blast hole explosives loading apparatus. After drilling is complete for a pattern of blast holes, the following apparatus is used to load multilateral holes. The key objectives are to selectively place a long bag or tube of explosives containing a detonator and booster into the desired blast-hole, to release it, and for the bag to then slump into place filling the entire cross section of the blast-hole. This full borehole filling is important to achieve maximum effectiveness of the explosive. An air or water gap would reduce velocity of detonation and shock wave coupling.

FIGS. 3A and 3B, at surface, a loading tube (30) is assembled to load the required volume of explosive.) The loading tube (30) is a set of internally smooth and flush tubes screwed together (35) similar to drill pipe or casing. they may be made of metal or more likely plastic or a composite. They are flexible enough to pass easily through the doglegs in the multilateral branches of the borehole.

The bottom of the loading tube (30) has a bottom nose, (38) that is shaped to easily pass in the bore holes and has a release mechanism that can be remotely released or opened to allow the loading bag to be released into the blast-hole. This can be remotely trigged via a pressure pulse sequence commonly used in oil well drilling or a radio frequency signal, or a device pumped from surface.

A "dummy run" may be made without explosive prior to loading explosives to ensure the blast-hole is free from debris depending on the risk of getting stuck with explosives.

In some realizations the release mechanism may be at the top of the loading bag and the bottom nose may be part of the bag or passive.

Inside the tube a long loading bag (31) is placed that is a larger diameter than the pipe and may be folded and secured to easily slide inside the loading tube. The materials are selected so friction is low between bag and tube, or a lubricant added.

In some realizations the bag may be an expandable tube or other device to serve the same functions. In some realizations there may be no bag and waterproof explosive emulsions injected directly.

Once this is hanging, fully assembled, at surface, a detonator (36) and booster (37) (as needed) are placed inside the loading bag, and then explosive slurry such as ANFO, emulsion or other liquid, gel or granular explosive are loaded via a hose or from a silo or hopper.

When the loading bag is filled, it is closed and the drill pipe used to convey the explosive loading tube into the hole. At the multilateral branch the tube passes easily as it is smaller in diameter and more flexible than the drilling assembly used to drill the hole.

Once the explosive is at the desired depth, the bottom nose is released and the loading bag slides into the hole, if mixture is selected to be higher density than water, alternatively it may be pumped hydraulically into place.

The tube is withdrawn and a "stemming" material (40) is pumped down the drill pipe.

A plug (not shown) may be set on top of the explosives that prevents a drill re-entering the hole if the whipstock is set incorrectly. This might be a help with regulatory approval but is not functionally needed.

Multiple charges or "decks" of explosive may be loaded sequentially in the same blast hole.

This operation is performed sequentially to load all the holes.

Various release devices and fishing equipment used in oil well drilling can be used to release and retrieve the device if it becomes stuck.

Figure 4:
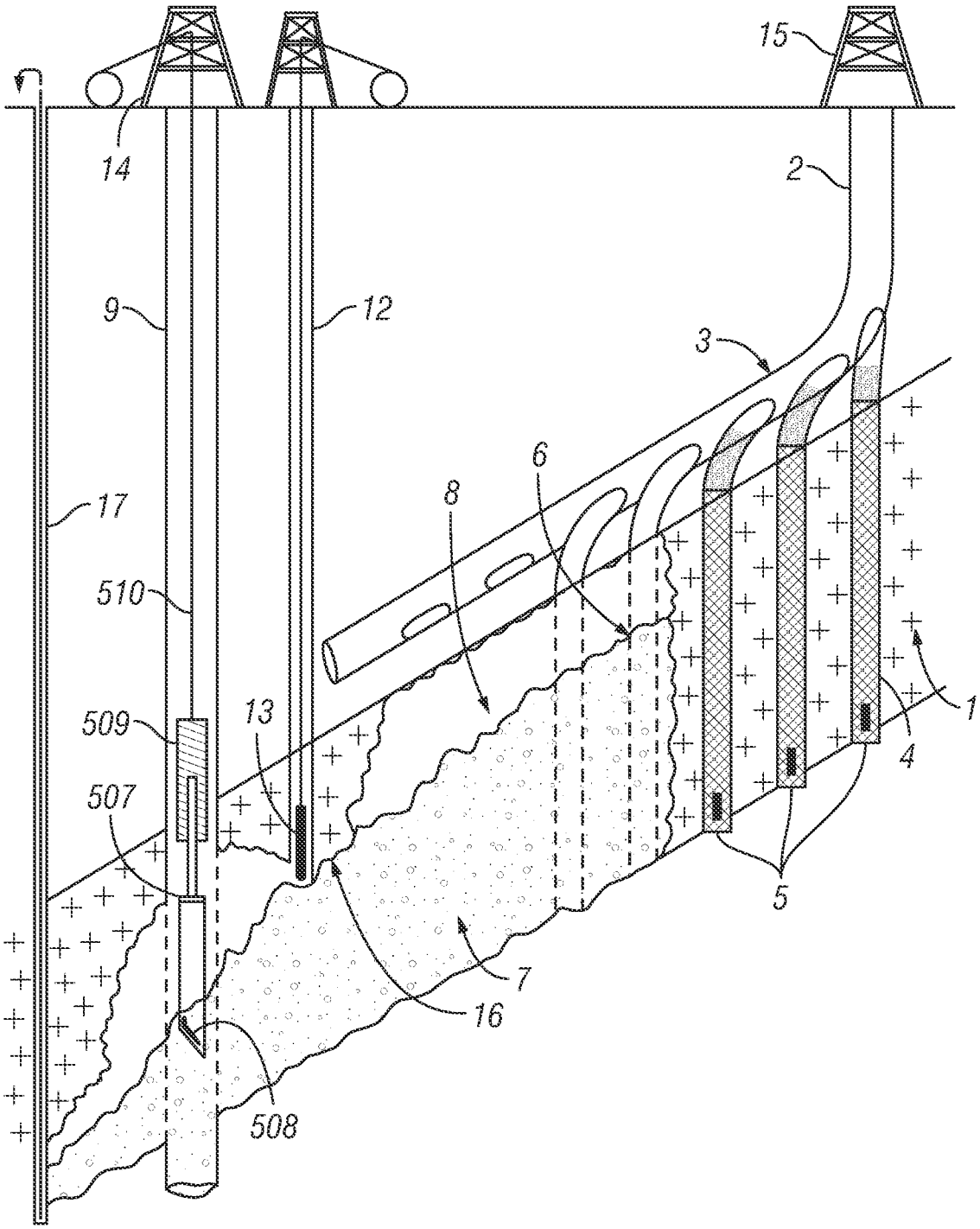
FIG. 4 shows a side view of the extraction method using a bucket conveyed with a cable winch.

FIG. 4 shows a side view of winch operated bailing system with draw point directly from muck pile for rock and ore extraction.

Reference numerals 1 through 17 show identical elements to those explained with reference to FIG. 1. Numeral (9) is a borehole or plurality of boreholes drilled from surface. The hole will follow a trajectory to reach the desired draw point into the ore at the desired point.

In this drawing a single extraction borehole is shown. in some cases, pairs of boreholes are drilled to allow a pair of bailing buckets to be deployed on counter wound winches connected by a common shaft, thus using the weight of one bucket being lowered to assist in the lifting of full bucket out of the shaft. The common shaft would have a clutch to allow jarring of the bottom bucket into the muck pile.

The draw point may be expanded from the normal circular diameter by repeatedly reaming the hole to create a vertically oriented oval borehole entering into the stope as a draw point. thereby creating space for the muck pile to flow freely. It may also be created by multilateral blast holes drilled out of borehole 9

Numeral (507) represents a bailing device or bucket and is a cylinder connected to a cable with the following features: a hard face shovel at the bottom to dig into the muck pile; the cylinder may have hinge mechanism to allow deployment in relatively tight curvature of build angle in the borehole. Numeral (508) represents a hatch to close and hold the rock while being pulled out of hole, a release mechanism to unload safely at surface.

Numeral (509) represents a jar assembly to use up and down motion of the winch to hammer the bucket into the muck pile and fill the bucket.

The bucket (507) and jar assembly (509) are conveyed at speed using a wire rope (510) from a winch at surface.

A second shaft type (12) can be drilled to lower a high velocity wire rope conveyed hammer (13) to break oversized rock in the draw point. Explosives such as shaped charges may be inserted via this shaft and manipulated with robotic arms and used to blast oversize rocks and to unblock the flow of the muck pile.

In most cases a shaft 17 would be drilled to intersect the stope at its lowest point to extract water via a submersible pump. In some cases, soluble, ore can be extracted via circulating water through the muck pile to increase the rate that ore is extracted. In some of these cases, not all the muck pile will be extracted, and this water extraction may prove an economic way to recover a soluble material that is being mined but cannot be extracted.

Figure 4A:
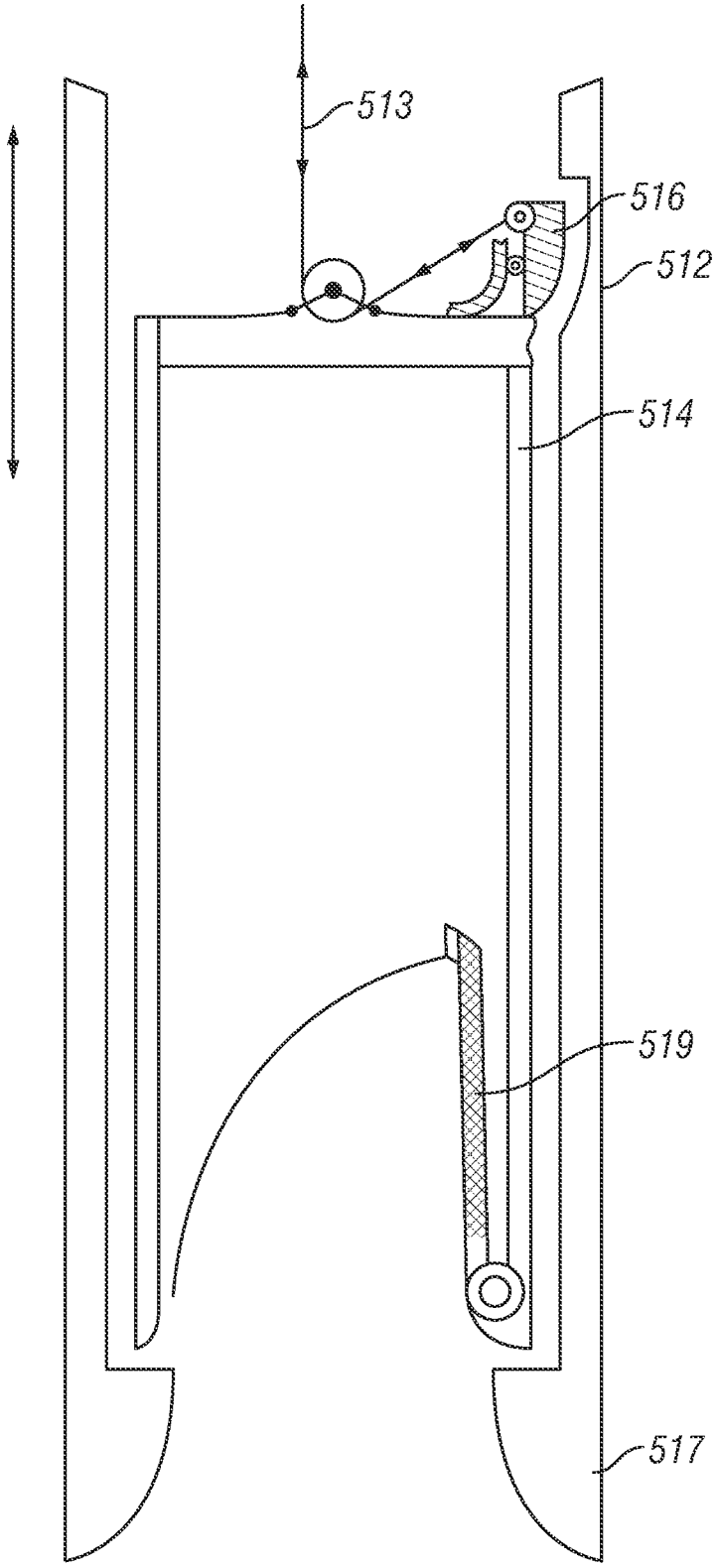
FIG. 4A shows a detailed view of an extraction bucket that is conveyed inside casing.

FIG. 4A shows a side view and detail of extraction machinery using bucket on wireline inside casing used to exert force. Instead of simply a wireline device the following device would replace the bucket (507), jar assembly (509), (510).

The wireline conveyed device can be run inside a pipe or casing (512) from surface, in this borehole a pipe or "casing" would be run. Typically, the pipe (512) would be a jointed pipe run with a drilling rig or similar hoisting apparatus. The casing (512) would be as large diameter as possible without sticking or excessive friction. Inside this pipe a bucket assembly (514) would be run on wireline (513) to allow rapid retrieval of the muck pile to surface.

The bucket assembly is a cylindrical device with a hatch (519) to allow the capture of the muck pile. The hatch (519) would open when pushed down into the muck pile and close when lifted up with material behind it.

The system would enter the muck pile in a draw point that may be constructed as explained with reference to FIG. 4.

The bucket would latch (516) into the casing such that the casing can be used to force down into the muck pile to fill the bucket with material. There would be a hardened scoop either on the casing shown at (517) or on the bucket to push into the fragmented rock. The latch would release allowing the bucket to be pulled to surface on the wireline (513), emptied and ran back into position.

The sequence of operation would be to firstly lift the casing above the muck pile. Second run the bucket down into position and latched. then the casing would be lowered into position filling the bucket with material. Then the casing is lifted up and the latch released (by pulling on the wire in this case) and the bucket pulled to surface and emptied. The process is continuously repeated to extract ore at the maximum rate.

The casing is held in some kind of rig or jacking system that allows it to be moved up and down as described. It may also be advantageous to be able to rotate the casing. It make also be advantageous to circulate water or air through this casing.

FIG. 5 shows a side view of extraction machinery using a hydraulic pump. In a realization where the blasting can fragment the rock sufficiently to extract small particles of rock without much crushing or drilling the ore material can be extracted through a single bore-hole with the use of a hydraulic Venturi or jet pump shown in this figure. This method may be limited by depth and hydraulics to relatively shallow depths.

An extraction borehole or boreholes (51) may be drilled from surface to a low point in the ore body to be extracted. Prior to blasting the first blast, the borehole is expanded as much as practically possible to create void space for the blasting to be effective.

Fragmented rock and ore (50), also known as a "muck pile" in mining, is blasted by the multilateral blasting methods is slumped in the cave created by the process of blasting.

A series of pipes are lowered into the borehole (56). At the bottom is a drill bit or crushing device that can use rotation or vertical motion to crush the fragment rock to be extracted. In this realization, the combination of rock properties and blasting effectiveness means this is an efficient process. The drill bit will wear out with time and can be replaced by pulling the whole assembly out of the hole.

High pressure water jets from the pipe (53) may assist the process as is common in oil well drilling. The crushed material passes through small passages (54) into the intake of a venturi jet pump (55)

Inside pipe (56) is an inner pipe (59) that is used as a conduit for the rock and water to flow to surface.

The driving force comes from high pressure water pumped down the annulus between the inner and outer pipe.

A jet pump (55) is used to convert the energy of high pressure water outside the inner pipe to pressure driving the mixture of rock and water to surface. The jet pump can be run on the inner pipe and removed and replaced by pulling out the inner pipe.

The power fluid pressure is pumped at the pressure and rate required to bring fluid and cuttings to surface.

Compressed air may be injected down a separate line to a point (57) in the inner string of pipe to provide air lift, that is, by reducing hydrostatic pressure to allow the Venturi to operate at high rates and at greater depths.

As water and rock is extracted, the "muck pile" will fall into the hole 51 and be continuously crushed and extracted.

It is common from blasting that up to 20% of material may be in the form of fine particles that can be extracted without crushing. In some cases, high grade ore is preferentially found in the fines and may be extracted at a profit without need for crushing by the flow of ground water or injected water and a pump. In this case different configurations of pumps may be used.

The fluid level in the stope may be controlled to increase bottom hole pressure to aid lifting material out of the hole or dropped to have more gravity drainage of water and fine materials.

Figure 6:
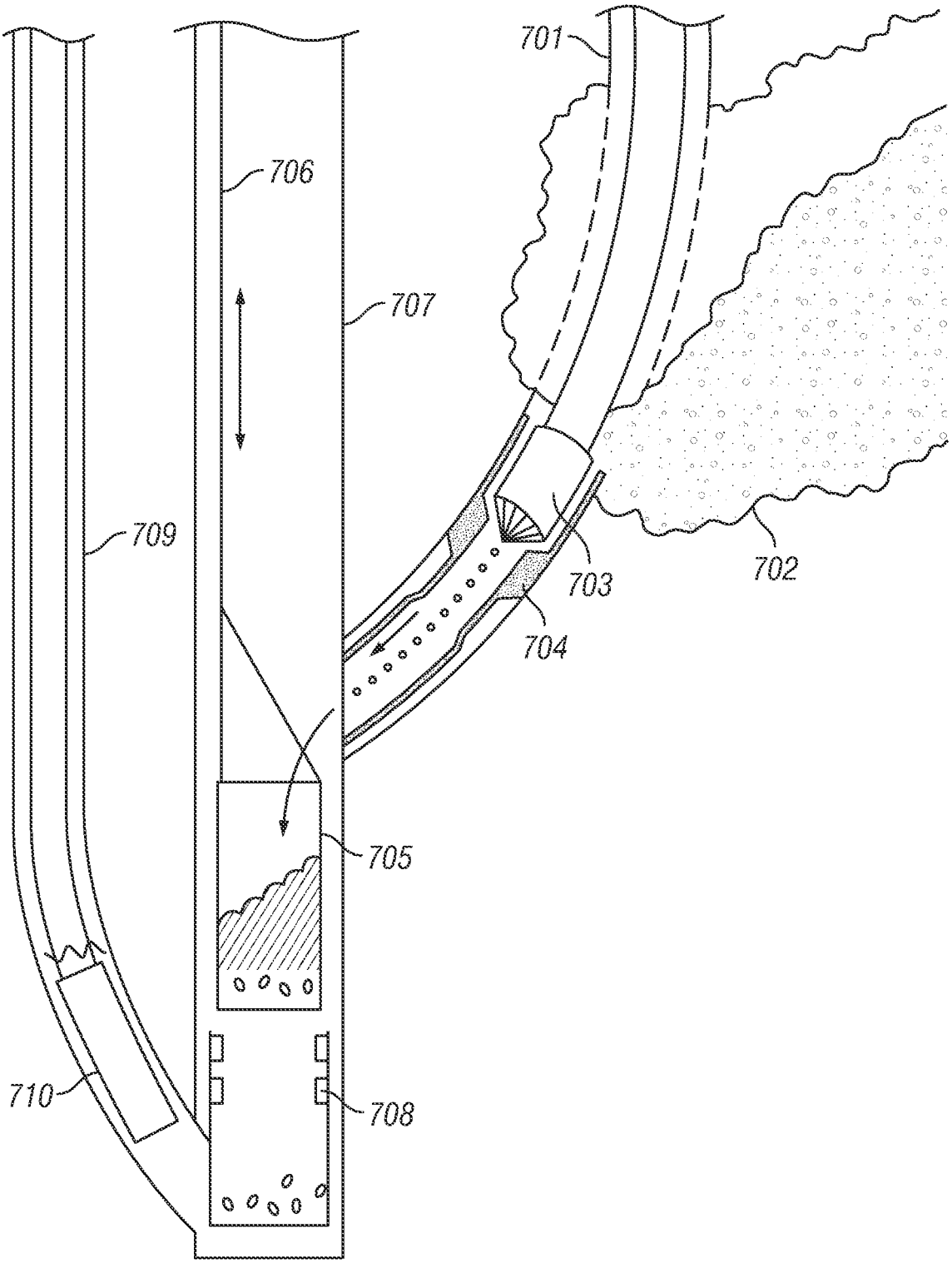
FIG. 6 shows a side view of extraction method using hoist and multiple shafts.

FIG. 6 shows a side view of extraction method using hoist and multiple shafts. The main figure shows a side view of the three extraction shafts from left to right: A dewatering bore hole (709), an extraction borehole (707), and crushing/feeder borehole (701) hardware within the crushing/feeding borehole (703) and (704). The foregoing apparatus may have the advantage over the previous embodiment that larger material up to the diameter of the elevator and feeder diameter can be extracted and processed at surface rather than crushed downhole as per the prior method. All apparatus is installed from surface via directional drilling. In the present example method, four separate shafts are drilled:

1. An extraction shaft (707) of diameter sufficient to hoist buckets of fragmented rock to surface. This would in most cases be the largest diameter of all shafts drilled.
2. A crushing and feed shaft (701) that serves the purpose of the initial void space for blasting and providing a conduit into the extraction shaft. It would intersect the extraction shaft to allow fragmented ore to fall into the bucket;
3. A dewatering shaft (709), drilled to house a water pump and tubing to extract water from the extraction shaft to allow winching of ore in an air filled shaft. At least one would intersect the extraction shaft to remove water; and
4. A multilateral blast hole shaft(s) for drilling blast holes. This would be likely be drilled to intersect the main crush and feed shaft to allow precise relative positioning.

The dewatering shaft is drilled into the extraction shaft to drain water. A water pump is installed, such as an electric submersible pump, and is run on the end of tubing. The water will contain a significant amount of solids so pumps with high solids tolerance are selected.

The elevator bucket (705) would normally have skate wheels to reduce friction and wear on the borehole wall. The borehole could be open hole without casing or with steel or other casing if required. It would be economically advantageous to minimize the need for casing. The elevator bucket (705) would have a "mouth" to catch as much falling rock as possible. The elevator bucket (705) is loaded via material falling from the feeder/crusher hole. Below the elevator is a second elevator bucket that could be engaged by a mechanism on wireline or drill pipe and winched out on a wireline cable (706) when full.

The feeder and crushing borehole (701) has the function of allowing a surface operated drill/crushing/pushing device (703) to break rocks to pass through a restricted diameter (704) and then pass through a section of tubing into the extraction shaft and elevator. The feeder and crushing borehole (701) is drilled from surface and intersects the extraction shaft below the ore body and muck pile (702).

Assembly (704) is inserted to stop just before the intersection point of the boreholes. It is secured via an open hole packer (standard oilfield equipment). Into the top of this is seated a replaceable tube that is hardened material to be used to crush rock against and also to control the diameter of rock passing. Against this device a milling/crushing assembly acts. The diameter of this is smaller than all restrictions downstream of it to prevent blockage. A drill pipe is inserted from surface and can perform the following actions; drill through the "muck pile of fragmented rock", crush rock and force it through the control diameter, in the event of blockage a small diameter spear can be inserted to clear out all material.

When the elevator bucket (705) is full of material the drill pipe closes the gap between the drill (703) and ore body (702) to prevent the flow of fragmented rock and allow the elevator to cycle to surface without much debris falling in the hole.

An alternative to the device shown at (703) and (704) is a rotary, screw-like assembly that forces material into the extraction shaft when rotated in one direction. If stationary it would prevent material falling into the extraction shaft when the bucket is round tripped to surface.

Figure 7:
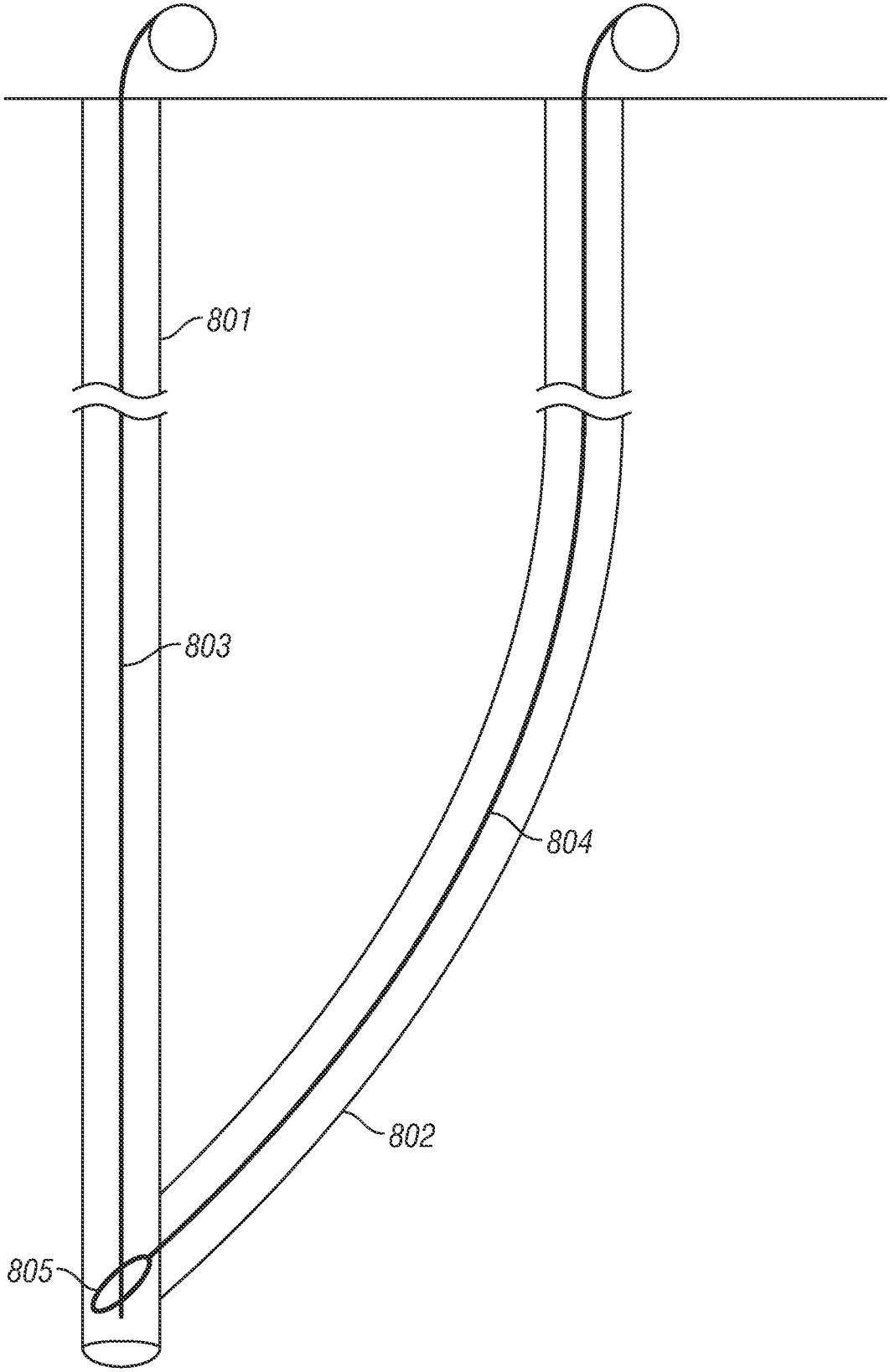
FIG. 7 shows a side view and detail of two boreholes to set up extraction machinery using wire loop method.
Figure 7A:
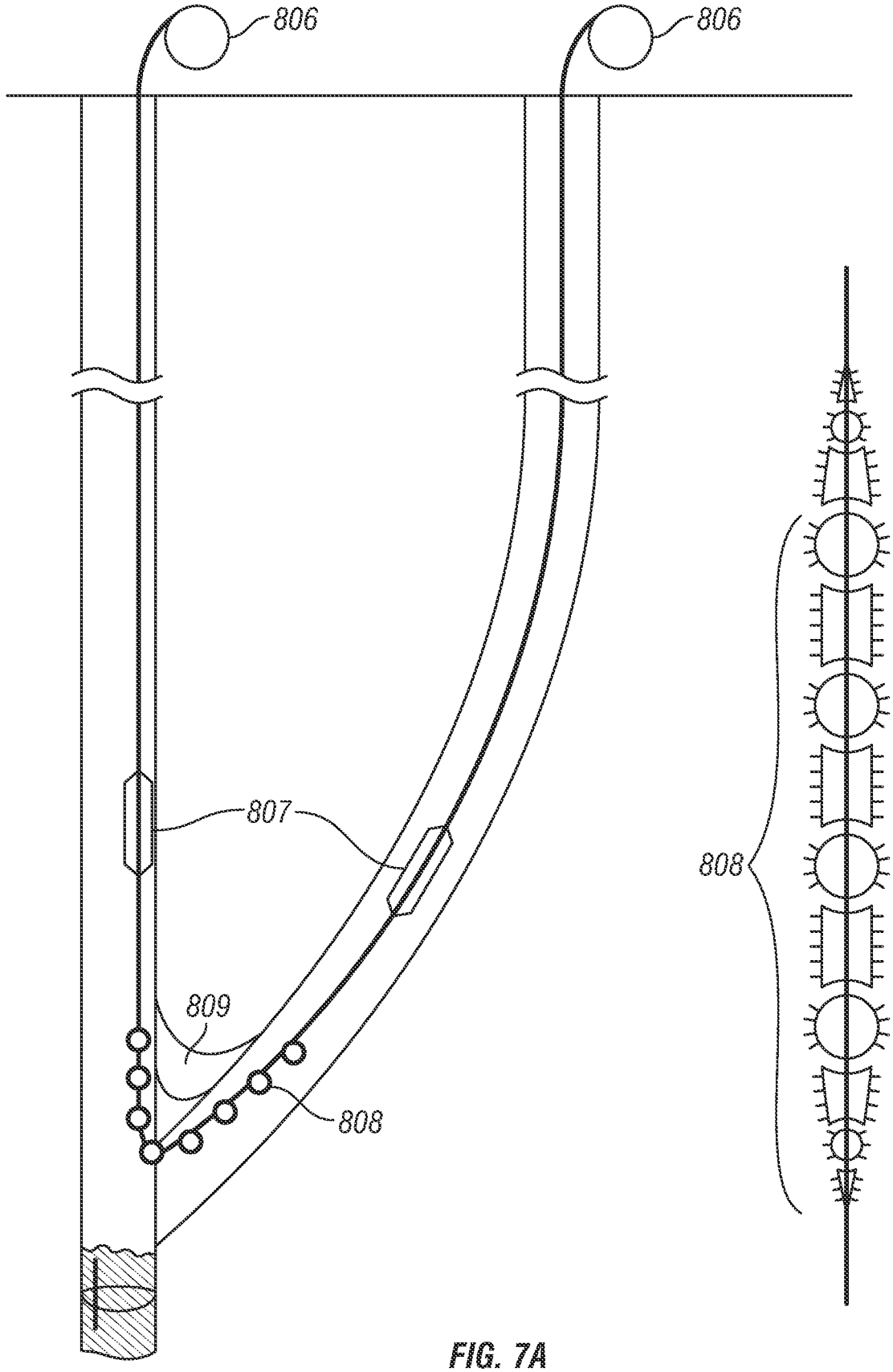
FIGS. 7A and 7B show, respectively, a side view and detail of using cutting apparatus to create two borehole loop system.
Figure 7B:
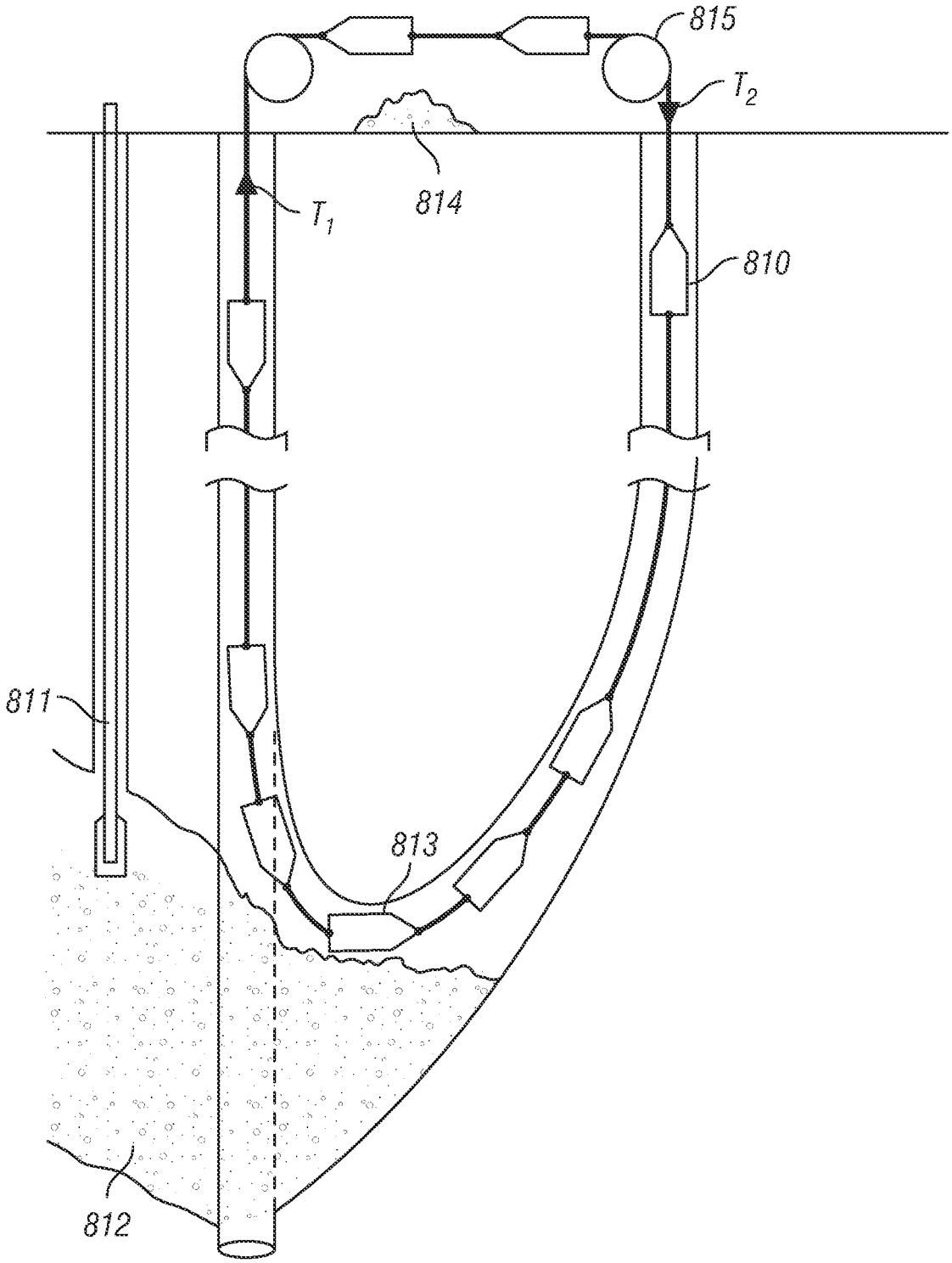

FIGS. 7, 7A and 7B show a side view and detail of extraction machinery using wire loop method via two boreholes. FIG. 7 shows a side view of pair of extraction boreholes drilled down to the point at which ore it is to be extracted. Both holes are drilled with a diameter to enable extractor of ore. They may be drilled as pilot holes and later expanded to a larger size. A first shaft (801) is drilled to the desired point and its position confirmed with accurate surveys. A second shaft (802) is drilled to intersect the first hole at a selected distance below the desired extraction point. The hole is drilled to intersect via accurate surveys or a magnetic locating method with a magnetic or electromagnetic device in the first shaft (801).

After the two service boreholes are drilled and successful intersect, a wire cable (803) is inserted into borehole (801) and a cable (804) is inserted into borehole (802) The second wire cable is grabbed by the first using mechanical, or magnetic methods. (805).

FIG. 7A shows the abrasive cutting method applied to make a formed path between the two boreholes. A pair of cable winches (806) is used to pass back and forth an abrasive cutting assembly (808) on strong cables to cut a path (809) between the two boreholes. roller or friction reduction devices (807) may be used to reduce friction and allow more efficient cutting and reduced cable ware.

FIG. 7B shows the two borehole system used as an extraction method for the mining process. ore buckets (810) are conveyed on strong cables throughout the pair of boreholes. An additional shaft (811) may be drilled to control ore flow and break oversize rocks. the muck pile (812) flows into the areas intersected by the borehole pair. The loop of wire allows the buckets (810) to scoop rocks (813) and bring them to surface (814) powered by winching systems (815)

Figure 8:
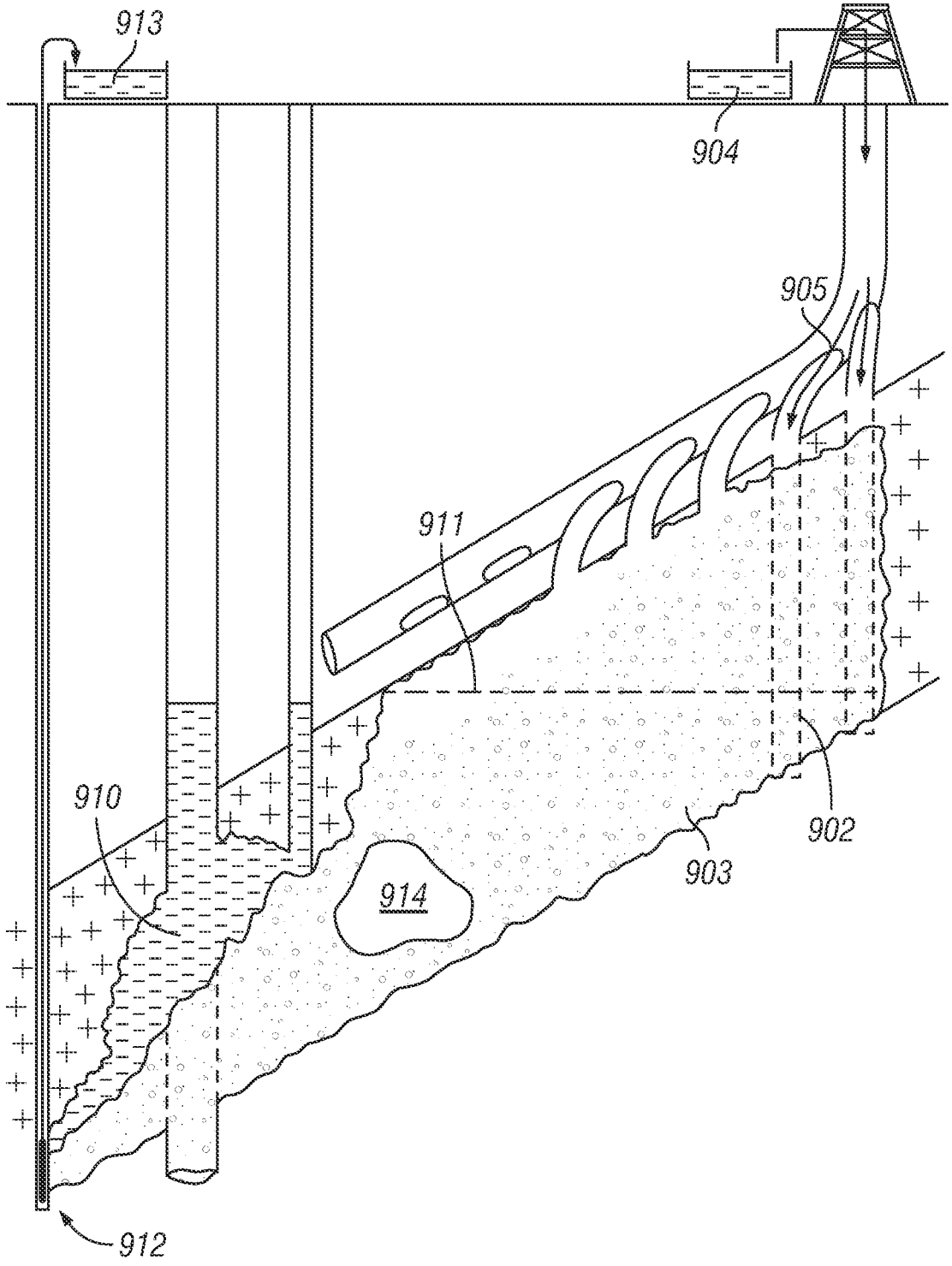
FIG. 8 shows post mining in situ leaching diagram.

FIG. 8 schematically shows in-situ leaching in stope created by multilateral blasting. In FIG. 8, the in-situ leaching process is illustrated as a continuation from what was explained with reference to FIG. 1. The remaining multilateral blast-holes (902) have been detonated using wireless detonators. The resulting muck pile fills much of the stope (903). This muck pile can be considered a leach heap created underground. Fluid (904) such as water or weak acid is pumped into a borehole flowing into the top of the stope (905). In this case it is the borehole used to drill the blast holes, but that may not always be the case.

In some cases, flow control devices may be used in the entry points to ensure even distribution of the fluid. The fluid fills much of the void space (910) and fills up the void and boreholes to a fluid level (911). The fluid flows through the fragmented material.

At the end of the process the fluid level can be lowered with more powerful pumps such that acids or other pollutants do not leach outside the fragmented stope area. Additional boreholes may be drilled to monitor and ensure leaching fluids do not migrate into groundwater.

Here is a detailed description of key sequence of steps:

(1) Appraisal and Project Selection

First, an ore body has been appraised and defined by diamond core drilling or reverse circulation drilling; as is common in industry the body is appraised as to its suitability to this method. This can all be done from surface and is done so today in most cases.

The most favourable economics for the method are likely to be when high grade and valuable ore is to be mined in a location where traditional methods are impractical due to rock mechanics, temperature, environmental restrictions or other factors.

The ore body should have enough vertical relief that the muck pile can be drained into a single or multiple points efficiency. This will be possible except in the case of relatively thin and flat layers of ore.

Rock mechanical properties should be evaluated to ensure that the method will work effectively. Drilling penetration rates should be estimated, and borehole stability evaluated, along with rock fragmentation distributions. The maximum stable open stope size should be determined to plan operations.

The hydrology should be carefully evaluated to determine the amount of water that is likely to enter the stope during mine workings. In most cases the method will use water based drilling fluids, however there are options for air drilling in cases where free water levels are low and fluid losses high.

Prior to starting, a detailed geometrical and engineering plan will be developed considering the ellipse of uncertainty for each borehole and the methods that can be used to position the boreholes such as magnetic ranging, and precision gyroscope technology. Such technologies are commonly used in oil and gas drilling.

2. Preparation

Drill sites prepared are located ideally to allow the majority of well bore length to be vertical to allow for rapid drilling and accurate survey positioning.

Tailings may be returned to the stope at some stage in mining, however some capacity to store drilling cuttings and tailings is required.

3. Borehole Drilling Extraction Hole and First Draw Point

Based on prior surveys, a near vertical borehole is drilled to a lower part of the ore body. The borehole will be optimized in size to extract material rapidly while being sized to be economically drilled with drill rigs available. Expected borehole size is 12 to 60 inches in diameter In this example it will be drilled vertically to a point at the bottom of the volume to be mined. A second hole may be drilled at this time and positioned next to the first.

4. Creating Void Space

At this point as much void space will be created at the section of the borehole where it intersects the ore body, and this will start with reaming tools. If rock is soft, jet blasting or abrasive cutting may be used. The void space is needed to blast into to create "accommodation" for the muck pile. In some cases, a plurality of side tracks close to the first hole may be made and then an explosive charge placed to expand the hole size.

Typically, in underground blasting a void space ratio ($V_r$) of between 30% to 50% of size of the blast is required to allow for movement of the rock fragments. If a 10 $m^3$ (10 m×1 m×1 m) initial void ($V_0$) is created the next blast may fragment 30 $m^3$ of material on the first blast pattern. The amount of material that can be blasted grows geometrically with each blast such that the volume blasted on the $n^{th}$ blast is $V_b=V_0\ (Vr)^{-n}$. Clearly maximizing initial void ($V_0$) and void space ratio ($V_r$) are important to efficient mining operations.

At this time, one or more vertical holes may be drilled to allow subsequent rock breaking to occur. These would be targeted to intersect the extraction holes at the point that will become the draw point. They will be steered to intersect using gyroscopic surveys and magnetic ranging tools of the type used in oil well drilling. A vertical borehole is ideal for this function.

At this time, a smaller bore hole may be drilled to allow pumping out of water. This would be done with a beam pump, progressing cavity or submersible pump inserted into the well. A vertical borehole is ideal for this function.

5. Drill Borehole for Multilaterals to Intersect Extraction Borehole

A borehole is then drilled to allow the multilateral drill and blast operations to occur. In this case it would drill down vertically to the top of the ore body, then curve over to follow above the top of the ore body and finally drop down near vertical to intersect the extraction borehole. This is done again using survey and ranging tools. It allows the survey to be tied in so the location of the boreholes relative to each other is precisely known.

This bore hole will typically be 30 cm in diameter to optimize drill cost and explosive placement options. This first borehole drilled from surface may be referred to as the primary or mother borehole.

At any time during the process of drilling any borehole, instead of conventional drilling, a core barrel or continuous coring method may be used to provide geological information on the ore and the rocks.

The borehole is then plugged back to a depth where multilateral junctions will be created to drill a series of blast holes.

6. Drilling Multilateral Blast—Holes

At this time a string of steel tubular casing is run into the hole that has a whipstock, window and anchor mechanism at the end. The casing will be designed to have minimum stretch and torsional flexibility. This casing will be positioned using a survey tool to orient it, and then clamped in place. The casing would be sized to minimize sticking risk in the borehole, typically 25 cm diameter. Part of t the whipstock may be made from a non-magnetic material.

As the system will be re-used many times for hundreds or thousands of multilateral blast-holes replaceable wear elements may be used to avoid casing and drill pipe wear.

Using directional drilling tools commonly used in oil and gas drilling, a side track is then drilled off the whipstock and landed next to the end of the extraction boreholes. This will be positioned in a desired pattern to enable blasting into the void space created by the extraction hole. The blast hole will be approximately 2-5 m from the extraction borehole.

While drilling, blast holes cuttings may be assayed for ore grade.

This drilling method may include but is not limited to the following drilling technologies; Measurement while drilling tools, a bent sub and drilling motor, a rotary steerable drilling system, coiled tubing drilling.

Gyroscope surveys may be run to precisely locate the hole. Typically, the hole will be drilled vertically as the survey error is minimized and closed loop control system can drill precise and efficient vertical holes.

After drilling, the casing will be precisely marked and its position recorded, and then be moved and rotated to drill as second branch or multilateral. This will be positioned in a desired pattern to enable blasting into the void space created by the extraction holes.

This process will be repeated until the first pattern of blast holes is drilled. Generally, each blast will require 30% of the volume of rock to be blasted as a void space. Thus, the first set of blast holes will likely be fewer in number; for example, 6 blast holes surrounding 2 extraction holes.

Typically, in underground blasting a void space ratio ($V_r$) of between 30% to 50% of size of the blast is required to allow for movement of the rock fragments. If a 10 $m^3$ (10 m×1 m×1 m) initial void ($V_0$) is created, the next blast may fragment 30 $m^3$ of material on the first blast pattern. The amount of material that can be blasted grows geometrically with each blast such that the volume blasted on the $n^{th}$ blast is $V_b=V_0 \cdot (Vr)^{-n}$. Clearly maximizing initial void ($V_0$) and void space ratio ($V_r$) are important to efficient mining operations.

It should be noted that the efficiency of side tracking, drilling and loading said blast holes is critical to the overall economics of the mining method.

7. Loading Blast Holes with Explosives

Once all of the initial blast holes are drilled, the explosives will be loaded. Casing will be moved to locate the window back at the first hole, and explosives will be placed in this hole. This will be repeated until all holes are filled.

Referring to FIG. 3, explosives, a booster and a radio frequency fired detonator will be loaded into a tube shaped bag, within a tube at surface for each blast-hole. Such through-rock radio frequency devices are available in the mining industry today. This assembly will be lowered into the hole on the drill pipe. It will be lowered into place, and then the bag will be released and will slump into place filling the desired volume of blast hole. Fluid may be circulated to actuate the release and ensure the explosives have been dropped at the correct depth. In some cases, multiple explosive systems may be loaded in each blast hole if the blast holes are long. Proper procedures will be developed to ensure this operation is safe. The explosive used would be most likely be either pre-packaged explosive tubes or water resistant emulsion explosives. In some cases, the pre-packages explosives may be of a diameter small enough to be pumped into place via drill pipe or tubing and then a liquid explosive pumped in place around them to fill the cross section of the borehole.

Stemming material such as gravel or drill cuttings may be circulated down or placed in a plug on top of the explosives.

In this case a plug may be set on top of the explosives that prevents a drill re-entering the hole if the whipstock is set incorrectly. This might be a help with regulatory approval but is not functionally needed.

Prior to firing the explosives, the casing and whipstock may be removed to prevent damage and a plug may be set to prevent fluid being blasted out of the borehole(s). Normally, prior to firing any water would be pumped out of the void space using a pump to maximize the effect of the explosives.

Once the first pattern of explosives is loaded, it will be fired with a sequence of radio signals from surface or a transmitter in one of the boreholes. The explosives will be fired with delays and sequences known to those practiced in the techniques of blasting.

8. Extracting Blasted Rock or "Muck Pile" Using Hoists

After the explosives are fired the material will be removed via the extraction hole holes. There are multiple methods of extraction which one is used will depend on depth, rock types, and rock fragmentation.

A key requirement is to ensure there is a free surface and void space at the point of extraction so the muck pile is not under confining stress, so it can be scooped or out without excessive forces being required. This will require the geometry of an extraction point or "draw" point to be created using the drilling and blasting methods created herein. The creation of draw points is common in underground mining, however in this case they will have to be created via drilling from surface.

For the mechanical extraction, in one realization this is done in this case with "buckets" that are run at speed into the fragmented rock or muck pile created by the explosives. The buckets will be run on wire rope and may have "jars" or sliding weights that can be used to hammer down on the bucket.

In another realization the bucket is ran inside a casing pipe that it can latch into at its bottom end. Once latched the casing can be moved at surface and apply force to push the bucket into the muck pile, thus filling it even when the muck pile is hard, compacted or contains oversize fragments. This bucket is a cylinder with open bottom with a trap door or jaws that close when it is lifted full of rock. The bottom edge will be hardened and sharpened to optimize recovery of the fragmented rock.

In another method a bucket is used in a similar way to a drag line where it is dragged up the muck pile free surface to be filled.

In another method two boreholes with a loop of cables will extract material in a continuous loop of buckets.

If the rock fragments are too large to be grabbed by the bucket hammer, devices can be lowered down one of the boreholes. Additional explosive charges may be used and/or drilling assemblies used to break the rock.

9. Extraction of Blasted Rock with a Hydraulic Jet Pump

The following describes the construction of the extraction borehole that uses a hydraulic jet pump to extract the fragmented rock. A borehole is used to extract blasted and drilled material from the target ore body. It is an alternative method to the use of wire rope conveyed buckets described previously. It may be more effective in shallower depths less than 150 m and where the rock is easily broken into small fragments by blasting, and hydraulics allow it to be pumped to surface.

An extraction shaft is drilled from a point on surface to the bottom point in the ore body deemed most efficient for the attraction of ore. This shaft would normally be of a large diameter that can be economically drilled, for example most cost effective. It may be drilled directionally if surface conditions deem otherwise.

The top of the shaft would be slightly larger diameter and may be cased with a steel tubular casing to prevent loose or weathered rock from falling into the hole during the process. If the rock is unstable, is highly permeable, has karst like voids or is fractured, the entire borehole down to the ore body might be cased off to prevent loss of fluids or borehole collapse.

Where the borehole intersects the ore to be extracted, the hole must then be enlarged to the largest practical diameter to create void space for future blasting operations to blast into. Reaming tools, water jetting other drilling methods may be used depending on rock properties. If a 0.5 m borehole is drilled this section may be enlarged to twice that diameter.

To increase the void space further, if needed, a smaller multilateral branch may be drilled from the top of the orebody departing at some deviation from the borehole. The borehole would typically be 2-4 borehole diameters from the main bore. An explosive charge is inserted into this multilateral and detonated. This multilateral may be smaller in diameter than the main bore.

The main hole is then drilled into the rubble or "muck pile" created from the prior blast. Rock fragments are circulated to surface and the void space around the hole is increased.

This borehole is then ready for the extraction using the methods described in "ore extraction" that is performed after each sequence of blasting operations are conducted.

This method may be repeated to extract from multiple points with a plurality of boreholes, or a borehole may be "side tracked" or altered in depth to a new location to extract more ore or ore from a different location.

Extraction processes are continued until enough material has been extracted for the next pattern of blasts. Extraction and drilling new blast holes can be conducted simultaneously.

The methods described here will extract ore and create a void space that is known in mining as a stope.

10. Mining Production Considerations

Additional blast holes will be drilled from the borehole used for blasting. They are positioned using the same service borehole and the whipstock/window assembly if possible. They are drilled to fragment as much ore as possible while minimizing dilution. Grade control can be performed on the drill cuttings while drilling. Wireline logging tool or logging while drilling from surface can be used for grade control. Precise surveys ensure the spacing between holes is accurate. Many blast holes may be drilled with each pattern becoming larger as more void space is created in the stope.

Generally, each pattern will be higher up in the ore body creating a stope that always has the muck pile falling down to the draw point created by the extraction borehole.

Blasting is designed to minimize oversize rocks that will block the extraction hole. High performance explosives will be used with the maximum powder factor. In traditional mining operations explosive load is limited by safety concerns for fly rock and vibration. In this case such concerns are far less restrictive and much higher powder factors can be used to give the maximum fragmentation. Smaller fragmentation can improve mineral recovery and reduce subsequent milling costs and is generally seen as advantageous in the mining process.

After some time, the borehole used to drill the multilateral borehole may need to be plugged back and side-tracked to a new location. In some cases, any one of the boreholes may collapse and require to be re-drilled.

The ultimate size of the stope of void space created may be limited by rock mechanics. In this case pillars of rock can be left intact to support the stope. In other cases, block caving may be desirable and the collapse of the overburden to crush the ore and extract said ore may be possible. In some cases, the method may provide intervention for an underground mine block caving operation that has failed to achieve desired caving performance.

The process of drilling and blasting will continue using the same boreholes and stope/void space as much as possible for cost efficiency. In some cases, the stope may be abandoned and a new one created so that tailings can be injected into the void space to reduce the tailings storage at surface.

So that the same extraction point may be used for multiple stopes a sequencing involving injecting tailings with cement may be used. In one realization, fine fill material is first injected in a hole used for extraction. Then some fraction of fill with added cement is poured into the stope via a blast hole. This creates a plug, after which un-cemented material can fill the remainder of the stope. Then the un-cemented material around the extraction hole is removed via circulation with drill pipe, and a new stope can be initiated from the same draw point with the cemented fraction holding the tailings material in place.

11. Multilateral Blast-Hole Drilling and Positioning.

One method is described in this section with references to other methods that may be disclosed in drawings and claimed as alternate methods.

The accuracy of survey positioning of boreholes that are drilled is most accurate when the boreholes are precisely vertical. It is possible to drill long deviated holes, but the accuracy of positioning decreases with the horizontal departure.

In one manifestation a second borehole is drilled that will become the primary borehole for a sequence of multilateral blast holes to then be drilled into the ore body. This will be described but it may be a plurality of boreholes or reuse the same main borehole as the extraction borehole if regulations allow.

The multilateral blast hole is drilled from surface and then drilled directionally some distance away from the ore body to be blasted so the main bore is not affected by the blast and the curved section of the borehole can be drilled so the blast holes penetrate the ore body in parallel.

Several branches may be drilled from said borehole, however here we consider a single branch. Additional branches may be drilled and then each one abandoned with a plug, and cement or a traditional open hole whipstock. In this way the cost of drilling from the surface is only incurred once for a large stope being created.

In one embodiment a moveable and reusable multilateral whipstock assembly is used to drill each blast hole. This is described in more detail in the drawing on movable casing multi-use multilateral whipstock device and drilling apparatus.

Glossary: Blow is a list of technical terms from oilfield technology and mining.

Oilfield terms use the term well bore interchangeably with the word borehole.

Blast-hole—A drill hole in a mine that is ultimately filled with explosives in order to blast loose a quantity of rock.

Geophysical survey—A scientific method of prospecting that measures the physical properties of rock formations. Common properties investigated include magnetism, specific gravity, electrical conductivity and radioactivity.

Stope—Any excavation in a mine, other than development workings, made for the purpose of extracting ore. The outlines of the orebody determine the outlines of the stope Muck—Ore or rock that has been broken by blasting.

Muck pile—muck in a pile after blasting.

Ore—A mixture of ore minerals and gangue from which at least one of the metals can be extracted at a profit.

Tailings—are the waste materials left after the target mineral is extracted from ore. They consist of crushed rock, water and residual materials used in ore separation.

Wireless Detonator—a device to initiate an explosive material that does not require any wires or fuses connected to it. Normally a radio frequency device such as the ORICA "webgen" device.

Wellbore and borehole maybe used interchangeably to refer to a hole drilled using a rotary drilling assembly.

Bucket in this case is used to describe a cylindrical container used to retrieve ore from the subterranean muck pile to surface.

Multilateral thought out this patent is defined as a borehole where multiple boreholes branch off the primary hole at some point in the subsurface. There may be multiple secondary branches from one primary hole and then additional branches subsequently drilled from each of those secondary boreholes.

Geo-steered/geosteering. Using the formation data generated by a measurement while drilling system to assist in drilling a wellbore to a specific target in the formation Drilling fluid drilling mud. The drilling-fluid system commonly known as the "mud system"—is the single component of the well-construction process that remains in contact with the wellbore throughout the entire drilling operation.

MWD the term MWD refers to measurements taken downhole with an electromechanical device located in the bottom-hole assembly (BHA).

Directional Drilling Directional drilling is defined as the practice of controlling the direction and deviation of a wellbore to a predetermined underground target or location.

Whipstock A hardened steel ramp along which a mill turns as it cuts a hole in the side of the casing to start a side-track or lateral wellbore.

Window, is an exit point of a lateral from a mother bore, generally a hole cut in the side of the borehole to allow side-tracking the well Survey. The method used to obtain the measurements needed to calculate and plot the 3D well path is called directional survey.

Logging while drilling Logging while drilling (LWD) refers to the addition of wireline-quality formation measurements to the directional data of a Measurement While Drilling (MWD) service.

Wireline logging Related to any aspect of logging that employs an electrical cable to lower tools into the borehole and to transmit data. Wireline logging is distinct from measurements-while-drilling (MWD) and mud logging.

In light of the principles and example embodiments described and illustrated herein, it will be recognized that the example embodiments can be modified in arrangement and detail without departing from such principles. The foregoing discussion has focused on specific embodiments, but other configurations are also contemplated. In particular, even though expressions such as in "an embodiment," or the like are used herein, these phrases are meant to generally reference embodiment possibilities, and are not intended to limit the disclosure to particular embodiment configurations. As used herein, these terms may reference the same or different embodiments that are combinable into other embodiments. As a rule, any embodiment referenced herein is freely combinable with any one or more of the other embodiments referenced herein, and any number of features of different embodiments are combinable with one another, unless indicated otherwise. Although only a few examples have been described in detail above, those skilled in the art will readily appreciate that many modifications are possible within the scope of the described examples. Accordingly, all such modifications are intended to be included within the scope of this disclosure as defined in the following claims.

What is claimed is:

1. A method for underground mining in a rock body, comprising:

drilling one or more service boreholes from at least one surface location into a subsurface rock body;

drilling a plurality of multilateral blast holes branching from at least one of the one or more service boreholes into the subsurface rock body using a rotary directional drilling apparatus extending from the surface;

loading the plurality of multilateral blast holes with one or more explosive charges and one or more detonators, the one or more explosive charges and the one or more detonators inserted from surface using a drilling assembly extending from the surface;

detonating the one or more explosive charges wirelessly to fragment the subsurface rock body; and extracting fragmented rock via the one or more service boreholes, to surface.

2. The method of claim 1 wherein after a volume of fragmented rock has been extracted, flushing a fluid through fragmented rock remaining underground to extract a soluble or finely fragmented constituent of the remaining rock.

3. The method of claim 1 wherein at least a portion of the one or more service boreholes are drilled to intersect in or near to a zone in the subsurface rock body to be extracted, a point of intersection of the at least a portion of the one or more service boreholes used as a location reference for other drilling operations.

4. The method of claim 1 wherein at least one service borehole is drilled using magnetic ranging or electromagnetic ranging relative to another borehole.

5. The method of claim 1 wherein the one or more of the plurality of multilateral blast holes are steered relative to measured geophysical properties of the subsurface rock body using sensors disposed on a drilling assembly to optimize a position of the one or more of the plurality of multilateral blast holes.

6. The method of claim 1 further comprising injecting tailings from surface into a void space created after a volume of the fragmented rock is extracted.

7. The method of claim 1 wherein the fragmented rock is extracted via one or more service boreholes using a winch-conveyed device to recover the fragmented rock from an underground muck pile and to move the fragmented rock to surface.

8. The method of claim 7 wherein the at least two service boreholes are drilled to intersect a lowermost point of the muck pile, and wherein the winch conveyed device comprises a bottom having a one way mechanism allowing fragmented rock to be collected when it is run into the muck pile.

9. The method of claim 8 wherein the winch conveyed device collects material by means of downward hammering action or vibration using a mass and cable.

10. The method of claim 1 wherein the one or more service boreholes comprise a first extraction borehole inside which is deployed a container to extract the fragmented rock, the container deployed on a winch, the one or more service boreholes comprising at least a second extraction borehole drilled to intersect first extraction borehole from a stope containing fragmented rock wherein gravity feeds fragmented rock into the second extraction borehole, wherein a container disposed in the second extraction borehole hoists the fragmented rock to surface.

11. The method of claim 10 wherein movement of the fragmented rock is controlled via a drill pipe or rod inserted into the second extraction borehole operated from surface, whereby the drill pipe or rod acting within the second borehole reduces fragment size of the fragmented ore.

12. The method of claim 1 wherein mechanical action by a drill pipe or cable conveyed device, or insertion of explosive devices in at least one of the or more service boreholes drilled through the subsurface rock body break the fragmented rock into smaller fragments to allow extraction of the smaller fragments to surface at least one of the one or more service boreholes.

13. The method of claim 1 wherein the fragmented rock is extracted with the use of a jet pump conveyed by concentric or parallel pipes in at least one of the one or more service boreholes.

14. The method of claim 1 wherein the plurality of multilateral blast holes are drilled using a whipstock device located within a pipe configured to be moved along a service borehole, and rotated within the service borehole and; an opening in said pipe facilitating subsequent directional drilling a blast-hole multilateral branch from the service borehole.

15. The method of claim 14 wherein the pipe is moved to a starting location and orientation for drilling each of a plurality of blast-hole multilateral branches, and then after each of the plurality of multilateral blast holes are drilled from each of the blast-hole multilateral branches, the pipe is returned to each starting location and orientation to facilitate loading of explosives into each of the plurality of multilateral blast-holes.

16. The method of claim 1 wherein the plurality of multilateral blast holes are drilled using an apparatus comprising; a pipe inserted into at least one of the one or more service boreholes, the pipe anchored in place, the pipe comprising a plurality of pre-cut windows to facilitate drilling a multilateral blast-hole, a plurality of locating devices to allow installation and locking of a whipstock with a corresponding one of the plurality of locating devices in a desired location to drill a set of multilateral blast-holes and a mechanism to release said whipstock to allow a next one in a sequence of sets of multilateral blast-holes to be drilled.

17. The method of claim 1 wherein the one or more explosive charges is loaded into at least one of the plurality of multilateral blast holes using an outer pipe having diameter smaller than a multilateral blast hole branch and a flexible inner sleeve having a diameter expandable to fill the multilateral blast hole branch, the flexible inner sleeve inserted inside the outer pipe, the inner sleeve filled with explosives, boosters and detonators, the outer pipe and the flexible inner sleeve run into the multilateral blast hole branch on a pipe, a release mechanism triggered to place the explosives in a desired position, and the flexible inner sleeve is released inside the multilateral blast hole branch, and the outer pipe is removed leaving the explosives expanding in the flexible inner sleeve to fill effectively an entire diameter of the multilateral blast hole branch.

18. The method of claim 1 wherein the one or more detonators is initiated with radio frequency signals having a specific identifier and firing code.

19. A method for underground mining in rock comprising:

drilling one or more service boreholes from a surface location into an underground rock body;

drilling a plurality of multilateral blast holes branching from one of the one or more service boreholes using a rotary directional drilling assembly extending from the surface;

loading one or more of the multilateral blast holes with one or more explosive charges and one or more detonators, the one or more explosive charges and the one or more detonators inserted from surface;

detonating the one or more explosive charges wirelessly to fragment the underground rock body; and extracting fragmented rock via an existing mine.

20. The method of claim 19 wherein the plurality of multilateral blast holes are drilled using a whipstock located within a pipe configured to be moved along a service borehole and rotated within the service borehole, an opening in said pipe facilitating directional drilling a subsequent blast-hole multilateral branch from the service borehole.

21. The method of claim 20 wherein the pipe is moved to a starting location and orientation for drilling each one of a plurality of blast-hole multilateral branches, the method further comprising drilling a set of multilateral blast holes from each of the plurality of blast hole multilateral branches, wherein after the set of multilateral blast holes is drilled from each blast-hole multilateral branch, said pipe is then returned to the starting location and orientation to facilitate loading of explosives into each of the set of multilateral blast holes drilled from each blast-hole multilateral branch.

22. The method of claim 19 wherein the plurality of multilateral blast holes are drilled using an apparatus comprising; a pipe inserted into one of the one or more service boreholes, the pipe anchored in place in the one of the one or more service boreholes, the pipe comprising a plurality of pre-cut windows to facilitate drilling a multilateral blast-hole, the pipe comprising a plurality of locating devices to allow installation and locking of a whipstock with a corresponding locating device in a desired location to drill a set of multilateral blast-holes, the pipe comprising a mechanism to release said whipstock to allow a next one in the set of blast-holes to be drilled.

23. The method of claim 19 wherein the one or more explosive charges are loaded into at least one of the plurality of multilateral blast holes using an outer pipe having a diameter smaller than a multilateral blast hole branch and a flexible inner sleeve having a diameter expandable to fill the multilateral blast hole branch, the flexible inner sleeve inserted inside the outer pipe, the flexible inner sleeve filled with explosives, boosters and detonators, the outer pipe and the flexible inner sleeve run into the multilateral blast hole branch on a service pipe, the method further comprising releasing a mechanism triggered to place the explosives in a desired position, the flexible inner sleeve released inside the multilateral blast hole branch and expanded, the outer sleeve removed leaving the explosives expanded in the released flexible inner sleeve to fill the diameter of the multilateral blast hole branch.

24. The method of claim 19 wherein at least one of the one or more detonators is initiated with radio frequency signals having a specific identifier and firing code.

25. A method for underground mining in rock comprising:

drilling one or more service boreholes from a surface location into an underground rock body;

drilling a plurality of subterranean multilateral blast holes into the rock body, the plurality of subterranean multilateral blast holes branching from at least one of the one or more service boreholes using a rotary directional drilling assembly extending from the surface;

loading the subterranean multilateral blast holes with one or more explosive charges and one or more detonators, the one or more explosive charges and the one or more detonators inserted from surface;

detonating the one or more explosive charges wirelessly to fragment the underground rock body; and flushing a fluid through the fragmented underground rock body to extract a soluble or finely fragmented constituent of the fragmented underground rock body.

26. The method of claim 25 wherein the plurality of subterranean multilateral blast holes are drilled using a whipstock located within a pipe configured to be moved along a service borehole and rotated within the service borehole; and wherein an opening in said pipe facilitating directional drilling a blast-hole multilateral branch from the service borehole.

27. The method of claim 26 wherein the pipe is moved to a starting location and orientation within the service borehole for drilling of each of a plurality of blast-hole multilateral branches, after each of the plurality of multilateral blast holes is drilled, said pipe is returned to each starting location and orientation to facilitate loading of explosives into each of the plurality of multilateral blast holes drilled from each blast-hole multilateral branch.

28. The method of claim 25 wherein the plurality of multilateral blast holes are drilled using an apparatus comprising; a pipe inserted into at least one of the one or more service boreholes and anchored in place in the at least one service borehole, the pipe comprising a plurality of pre-cut windows to facilitate drilling one or more of the plurality of subterranean multilateral blast-holes, the pipe comprising a plurality of locating devices to allow installation and locking of a whipstock with a corresponding locating device in a desired location in the at least one service borehole to drill a set of the plurality of subterranean multilateral blast-holes, the pipe comprising a mechanism to release said whipstock to allow a next one in a sequence of multilateral blast-holes to be drilled.

29. The method of claim 25 wherein the one or more explosive charges is loaded into at least one of plurality of subterranean multilateral blast holes using an outer pipe having diameter smaller than a diameter of a multilateral blast hole branch and a flexible inner sleeve having diameter expandable to fill the multilateral blast hole branch, the flexible inner sleeve inserted inside the outer pipe, the flexible inner sleeve filled with explosives, boosters and detonators, the outer pipe and the inner sleeve run into the multilateral blast hole branch on a conveyance pipe, a release mechanism triggered to place the explosives in a desired position, the flexible inner sleeve released and expanded inside the multilateral blast hole branch, the outer sleeve removed leaving the explosives expanding in the flexible inner sleeve to fill the diameter of the multilateral blast hole branch.

30. The method of claim 25 wherein the one or more detonators is initiated with radio frequency signals having a specific identifier and firing code.

* * * * *